US006756959B2

(12) United States Patent
Fujino

(10) Patent No.: US 6,756,959 B2
(45) Date of Patent: Jun. 29, 2004

(54) DISPLAY DRIVING APPARATUS AND DISPLAY APPARATUS MODULE

(75) Inventor: Hiroaki Fujino, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 236 days.

(21) Appl. No.: 09/982,009

(22) Filed: Oct. 19, 2001

(65) Prior Publication Data

US 2002/0080131 A1 Jun. 27, 2002

(30) Foreign Application Priority Data

Dec. 26, 2000 (JP) ..... 2000-396109

(51) Int. Cl.[7] ..... G09G 3/36
(52) U.S. Cl. ..... 345/95; 345/87; 345/89
(58) Field of Search ..... 345/95, 89, 87, 345/98, 99, 100, 90

(56) References Cited

U.S. PATENT DOCUMENTS 5,061,920 A * 10/1991 Nelson ..... 345/89
5,376,926 A * 12/1994 Sano ..... 345/89
5,712,634 A * 1/1998 Janssen ..... 341/144
5,784,041 A * 7/1998 Okada et al. ..... 345/89
6,002,384 A * 12/1999 Tamai et al. ..... 345/95
6,104,364 A * 8/2000 Hayashi ..... 345/87
6,151,005 A * 11/2000 Takita et al. ..... 345/89

* cited by examiner

*Primary Examiner*—Steven Saras
*Assistant Examiner*—Fritz Alphonse
(74) *Attorney, Agent, or Firm*—Birch, Stewart, Kolasch & Birch, LLP

(57) ABSTRACT

A display driving apparatus in accordance with the present invention outputs a plurality of types of driving voltages that vary depending on display data to display device from a plurality of output terminals for liquid crystal driving voltages via voltage follower circuits. Each of the voltage follower circuits is connected with the output terminals for liquid crystal driving voltages via an analog switch circuit. The analog switch circuit is shared by the output terminals for liquid crystal driving voltages in accordance with the switching of the analog switch circuit. This allows to suppressing the increasing in the circuit scale with the increasing in the number of terminals and the increasing of the power consumption.

18 Claims, 19 Drawing Sheets

DISPLAY DRIVING APPARATUS AND DISPLAY APPARATUS MODULE

FIELD OF THE INVENTION

The present invention relates to display driving apparatus and display apparatus module that are capable of suppressing the circuit scale and reducing the power consumption of the circuit.

BACKGROUND OF THE INVENTION

FIG. 9 is a block diagram showing a liquid crystal display apparatus of a TFT (Thin-Film Transistor) type that is a typical one of active matrix types.

The liquid crystal display apparatus is provided with a liquid crystal display section and a liquid crystal display apparatus (liquid crystal driving circuit) that drives the liquid crystal display section. The liquid crystal display section is provided with a liquid crystal panel 901 of TFT-type. The liquid crystal panel 901 is provided with a plurality of display unit elements (pixels) that are disposed in a matrix manner and an opposite electrode (common electrode) 906.

In the mean time, the liquid crystal driving apparatus is provided with source driver 902 and gate driver 903 each of the drivers including an IC (Integrated Circuit) chip, a controller 904, and a liquid crystal driving power source 905.

The source driver 902 and the gate driver 903 are provided as follows, in general. More specifically, by providing, on ITO (Indium Tin Oxide) terminals that are provided so as to extend from the inside of the liquid crystal panel 901 toward its peripheral part, such as a TCP (Tape Carrier Package) that is realized by mounting the IC chip on a film which has been subjected to a predetermined wiring, and combining, or providing the IC chip directly to the ITO terminals of the liquid crystal panel 901 via an ACF (Anisotropic Conductive Film) by means of thermal bonding, and combining, the drivers are provided.

In order to further miniaturize the liquid crystal display apparatus, the controller 904, the liquid driving power source 905, the source driver 902, and the gate driver 903 are combined so as to have 1-chip structure, or 2-chip structure, or 3-chip structure. FIG. 9 shows these structures separately for respective functions.

The controller 904 outputs to the source driver 902 (a) the digitized display data (for example, RGB image signals corresponding to red, green, and blue, respectively) indicated as D in FIG. 9 and (b) respective control signals indicated as S1 in FIG. 9. The controller 904 also outputs respective control signals indicated as S2 in FIG. 9 to the gate driver 903. The source driver 902 mainly receives the control signals such as a horizontal synchronizing signal (a latch signal Ls), a start pulse signal, and a clock signal for source driver-use. The gate driver 903 mainly receives the control signals such as a vertical synchronizing signal and a clock signal for gate driver-use. Note that a power source that drives the respective IC chips (gate driver IC and source driver IC) is omitted in FIG. 9.

The liquid crystal driving power source 905 supplies the source driver 902 and the gate driver 903 with a voltage for liquid crystal panel display-use (a reference voltage for generating a voltage for gradation display-use).

The display data that have been externally inputted are sent to the source driver 902 via the controller 904 as the display data D that are a digital signal. The source driver 902 carries out the sampling with respect to the inputted display data D in a time—sharing manner and store the sampling result, and then carry out the D/A conversion in which the display data D is converted into the voltage for gradation display—use so as to be in synchronization with the horizontal synchronizing signal (may be referred to as a latch signal Ls).

The source driver 902 sends the analog voltage for gradation display-use (the voltage for gradation display-use) that is a resultant of the D/A conversion to an associated source signal line 1004 (see FIG. 10) provided in the liquid crystal panel 901 via the liquid crystal driving voltage output terminal.

The following description deals with the structure of the liquid crystal panel 901 with reference to FIG. 10. The liquid crystal panel 901 is provided with pixel electrodes 1001, pixel capacitor 1002, TFTs 1003 acting as switching device that carry out ON/OFF the voltages applied to the respective pixels, source lines 1004, gate signal lines 1005, and an opposite electrode 1006 of the liquid crystal panel (corresponding to the opposite electrode 906 shown in FIG. 9). Note that the area indicated as "A" corresponds to a single pixel in FIG. 10.

The voltage for gradation display-use having the amplitude that varies depending on the brightness displayed in each target pixel is supplied to the source line 1004 from the source driver 902 shown in FIG. 9. Scanning signals are applied to the respective gate signal lines 1005 from the gate driver 903 shown in FIG. 9 so that a plurality of TFTs 1003, that are provided in a longitudinal direction (i.e., in a direction in which the source signal lines 1004 are extended) are successively turned ON.

In the case where a TFT 1003 is turned ON, when a pixel electrode 1001 connected with the drain of such a TFT 1003 receives the voltage for gradation display-use from the source signal line 1004, electric charges are stored (charged) in the pixel capacitor 1002 formed between the pixel electrode 1001 and the opposite electrode 1006. Then, when the selection by the gate signal lines 1005 is completed and the TFT 1003 changes into an OFF (non-selection) state, the voltages that have been written into the pixel capacitor 1002 are maintained. The ON/OFF operation causes the light transmittance of the respective display unit elements (pixels) to change in accordance with the level of the voltage for gradation display-use that has been written into each pixel. This allows to realizing a target gradation display.

FIGS. 11 and 12 show an example of the waveform of the liquid crystal driving voltage to be applied to the source signal line 1004, the gate signal line 1005, and the pixel electrode 1001 shown in FIG. 10, respectively. In FIGS. 11 and 12, reference numerals 1101 and 1201 show the waveform of the voltage for gradation display-use outputted from the source driver 902 to the source signal line 1004. In FIGS. 11 and 12, reference numerals 1102 and 1202 show the waveform of the scanning signal, for controlling of ON/OFF of the TFT 1003, that is outputted from the gate driver 903 to the gate signal line 1005. Note that when the reference numeral 1102 or 1202 is a high level, the TFT 1003 is in an ON state, and when a low level, the TFT 1003 is in an OFF state.

In FIGS. 11 and 12, reference numerals 1103 and 1203 show the electrical potential (voltage) of the opposite electrode 1006 (see FIG. 10), and 1104 and 1204 show the waveform of the voltage to be applied to the pixel electrode 1001. The change (see FIG. 11, for example) in the waveform of the voltage to be applied to the pixel electrode 1001 is explained by the fact that the voltage level corresponding to the electric charges charged in the pixel capacitor 1002 during the period of time in which (a) the TFT 1003 is turned ON when the scanning signal 1102 is a high level, this causes that the pixel capacitor 1002 starts to be charged (i.e., the voltage 1101 for gradation display-use is written), (b) the scanning signal is a low level so that the TFT 1003 is turned OFF, when the voltage across the pixel capacitor 1002 reaches a predetermined voltage level, and (c) thereafter, the scanning signal becomes a high level again. Note that the similar description is made with respect to the voltage of the waveform indicated as the reference numeral 1204 shown in FIG. 12.

Note that the voltage to be applied to the liquid crystal material (not shown) is equal to the difference of electric potentials (voltage difference) between the pixel electrode 1001 and the opposite electrode 1006 (see the oblique lines shown in FIGS. 11 and 12).

In FIGS. 11 and 12, the amplitudes of the respective voltages 1101 and 1201 for gradation display-use to be applied to the source signal line 1004 are different from each other. This allows to carrying out the display so as to have respective different gradations. In other words, the amplitude of the voltage for gradation display-use is changed so that the voltage differences (see the oblique lines shown in FIGS. 11 and 12) between the pixel electrode 1001 and the opposite electrode 1006 are different from each other, thereby realizing a target gradation display. Note that the number of the gradations that can be displayed is determined in accordance with the number of the possible selections of the voltages to be applied to the liquid crystal material, i.e., in accordance with the number of selections of the amplitudes of the voltages for gradation-use outputted as the analog signal.

By the way, the present invention relates to an output circuit in a circuit for gradation display-use that occupies especially great circuit scale and power consumption. Accordingly, the following description deals with the liquid crystal driving apparatus mainly focusing on the source driver 902.

FIG. 13 shows a block structure of the source driver 902. The following description deals with its basic parts with reference to FIG. 13. Digital display data DR, DG, and DB (for example, each being 6-bit data) that are respectively transmitted from the controller 904 (see FIG. 9) are once latched by an input latch circuit 1301. Note that the Digital display data DR, DG, and DB correspond to red, green, and blue data, respectively, and have been referred to as the display data D in FIG. 9.

A start pulse SP and a clock signal CK for source driver-use are supplied to the source driver 902 from the controller 904. The start pulse SP is successively transmitted through the respective stages in the shift register in synchronization with the clock signal CK. This causes that (1) each stage of the shift register circuit 1302 outputs an output signal to a sampling memory circuit 1303 and (2) the final stage of the shift register circuit 1302 outputs a start pulse signal SP (a cascade output signal S) for source driver-use to the source driver of the next stage.

In synchronization with the output signal outputted from each stage of the shift register circuit 1302 to a sampling memory circuit 1303, the digital display data DR, DG, and DB that have been latched by the input latch circuit 1301 are once stored by the sampling memory circuit 1303 in a time-sharing manner and are outputted to the next hold memory circuit 1304.

More concretely, when the digital display data DR, DG, and DB corresponding to one horizontal synchronizing signal (see FIG. 14) are stored by the sampling memory circuit 1303, the hold memory circuit 1304 fetches the output signals from the respective stages of the sampling memory circuit 1303 in accordance with the horizontal synchronizing signal (the latch signal Ls) that is supplied from the controller 904 (see FIG. 9) so as to output the output signal thus fetched to a level shifter circuit 1305 of the next stage. Simultaneously, the hold memory circuit 1304 maintains the digital display data DR, DG, and DB until the next horizontal synchronizing signal is supplied. Along with the outputting operation, the hold memory circuit 1304 maintains the digital display data DR, DG, and DB until the next horizontal synchronizing signal is inputted.

The level shifter circuit 1305 is provided for converting and outputting the input signal by such as boosting (increasing) the input signal so as to be suited to the D/A converter circuit 1306 of the next stage that proceeds the voltage to be applied to the liquid crystal panel 901 (see FIG. 9). A reference voltage generation circuit 1309 generates a variety of analog voltages for gradation display-use in accordance with a reference voltage VR outputted from a liquid crystal driving power source 905 (see FIG. 9) and sends them to the D/A converter circuit 1306.

The D/A converter circuit 1306 selects an analog voltage, among the variety of analog voltages supplied from the reference voltage generation circuit 1309, in accordance with the digital display data that have been subjected to the level conversion by the level shifter circuit 1305. The analog voltage showing the gradation display is outputted to the respective source signal lines 1004 of the liquid crystal panel 901 from the respective output terminals 1308 for liquid crystal driving voltages (hereinafter referred to as the output terminals, merely) via the output circuit 1307. The output circuit 1307 acts as a buffer circuit, and is realized by a voltage follower circuit adopting such as differential amplifier circuits.

Note that FIGS. 14, 15(*a*), and 15(*b*) show timing charts of the input signal or the output signal of the source driver 902 and the gate driver 903 (see FIG. 9) which have been described with reference to FIGS. 9 through 13. As shown in FIG. 14, (*a*) the vertical synchronizing signal which is inputted to the gate driver 903 from the controller 904 and (*b*) the horizontal synchronizing signal (the latch signal Ls) which is inputted to the source driver 902 are outputted so as to have a predetermined relation between them. Further, the scanning signals of the respective gate signal lines $G_1$ through $G_n$ of the gate driver 903 (corresponding to the gate signal line 1005 shown in FIG. 10) successively outputs selection pulse (a voltage signal of High level shown in FIG. 12) in synchronization with the horizontal synchronizing signal once a vertical synchronizing period.

In contrast, as has been described earlier, the scanning signal, the clock signal CK for source driver—use, the start pulse signal SP, the digital display data DR, DG, DB (referred to as the display data signal in the drawing), and the horizontal synchronizing signal have the relation among their waveforms shown in FIG. 15(*a*). The signal waveform (the source driver output in the drawing) to be outputted to the respective source signal lines 1004 from the output terminals 1308 of the source driver 902 has the relation shown in FIG. 15(*b*). Note that FIGS. 15(*a*) and 15(*b*) show an example in which the output terminals 1308 of the source driver 902 are constituted by totally 300 terminals, i.e., X1 through X100, Y1 through Y100, and Z1 through Z100 (100 output terminals for colors R, G, and B, respectively). This ensures to cope with 64 gradation displays as follows.

Here, the following description deals with the circuit configuration of the reference voltage generation circuit 1309, the D/A converter circuit 1306, and the output circuit 1307 in detail with mainly reference to FIGS. 13, 16, 17, and 18.

FIG. 16 shows an example of the circuit configuration of the reference voltage generation circuit 1309. When the digital display data DR, DG, and DB for respective colors R, G, and B are constituted by 6 bits, respectively, the reference voltage generation circuit 1309 outputs 64 types of analog voltages that correspond to 64 ($=2^6$) gradation displays. The following description deals with its concrete circuit configuration.

The reference voltage generation circuit 1309 is realized by the simplest configuration of a resistor division circuit in which resistors $R_0$ through $R_7$ are connected with each other in a series manner. Each of the resistors $R_0$ through $R_7$ is realized by eight resistors that are connected with each other in series. For example, as to the resistor $R_0$, as shown in FIG. 17, eight resistors $R_{01}$, $R_{02}$, . . . , $R_{07}$, $R_{08}$ are connected in series with each other, thus the resistor $R_0$ is realized. The other resistors $R_1$ through $R_7$ are realized by the configuration similar to the resistor $R_0$. Thus, the reference voltage generation circuit 1309 is realized by totally 64 resistors that are connected in series with each other. Note that each of the resistors $R_0$ through $R_7$ are determined by considering such as the gamma ($\gamma$) correction.

The reference voltage generation circuit 1309 is provided with nine (9) half tone voltage input terminals corresponding to nine reference voltages $V'_0$, $V'_8$, . . . , $V'_{56}$, $V'_{64}$. The half tone voltage input terminal corresponding to the reference voltage $V'_{64}$ is connected with one end of the resistor $R_0$. The half tone voltage input terminal corresponding to the reference voltage $V'_{56}$ is connected with the other end (i.e., the connection point connecting the resist $R_0$ and the resistor $R_1$). The connection points of the respective neighboring resistors $R_1$ and $R_2$, $R_2$ and $R_3$, . . . , and, $R_6$ and $R_7$ are connected with the half tone voltage input terminals corresponding to the reference voltages $V'_{48}$, $V'_{40}$, . . . , $V'_8$, respectively. One end of the resistor $R_7$ whose other end is connected with the resistor $R_6$ is connected with the half tone voltage input terminal corresponding to the reference voltage $V'_0$.

With the circuit configuration, it is possible to obtain the voltages $V_1$ through $V_{63}$ from the connection points connecting the respective two neighboring resistors of the 64 resistors. Thus, the voltages $V_1$ through $V_{63}$ and the voltage $V_0$ provide totally 64 kinds of analog voltages ($V_0$ through $V_{63}$) for gradation display-use. Namely, when the reference voltage generation circuit 1309 is realized by the resistor division circuit, the analog voltages $V_0$ through $V_{63}$ for gradation display—use are determined in accordance with the ratios of the 64 resistors. The 64 analog voltages $V_0$ through $V_{63}$ are sent to the D/A converter circuit 1306 from reference voltage generation circuit 1309.

Note that the reference voltages $V'_0$ and $V'_{64}$ of both ends are always applied to the half tone voltage input terminals in general, while seven half tone voltage input terminals corresponding to the reference voltages $V'_8$ through $V'_{56}$ are used for fine adjustment. In actual, there are some cases where no voltages are applied to such seven half tone voltage input terminals.

The following description deals with the D/A converter circuit 1306. FIG. 18 shows an example of the circuit configuration of the D/A converter circuit 1306. Note that the circuit configuration (voltage follower circuit) of the output circuit 1307 is also shown in FIG. 18.

In the D/A converter circuit 1306, a MOS transistor or a transmission gate is provided as each analog switch (hereinafter referred to as a switch) so that one of the inputted 64 analog voltages $V_0$ through $V_{63}$ is selected in accordance with the display data made of the 6-bit digital signal. More specifically, the switch is turned ON or OFF in accordance with each bit (Bit0 through Bit5) of the display data made of 6-bit digital signal. This allows one of the inputted 64 analog voltages to be selected and outputted to the output circuit 1307. The following description deals with the selection and outputting.

In the 6-bit digital signal, the Bit0 indicates an LSB (the Least Significant Bit) and the Bit 5 indicates an MSB (the Most Significant Bit). The switches are arranged so that two switches form one pair. 32 pairs of switches (64 switches) are provided for (correspond to) the Bit0. 16 pairs of switches (32 switches) are provided for the Bit1. The number of the switches is reduced to be half for each Bit. Finally, a pair of switches (2 switches) is provided for the Bit5. Namely, 63 ($=2^5+2^4+2^3+2^2+2^1+1$) pairs of switches (126 switches) are totally provided.

One end of the switches corresponding to Bit0 acts as an input terminal for the foregoing respective voltages $V_0$ through $V_{63}$. The other ends of the respective two switches are connected with each other, and are further connected with one end of the switches corresponding to Bit1. Thereafter, these connecting arrangements are repeated up to the switches corresponding to Bit5. Finally, one electric line is drawn from the switches corresponding to Bit5 so that it is connected with the output circuit 1307.

It is assumed that the switches corresponding to Bit0 through Bit5 are referred to as switch groups $SW_0$ through $SW_5$. Each switch of the switch groups $SW_0$ through $SW_5$ is controlled in accordance with the 6-bit digital display data (Bit0 through Bit5) as follows.

In the switch groups $SW_0$ through $SW_5$, when the corresponding Bit is "0" (Low level), one (corresponding to the lower switch in the drawing) of the two analog switches that form a pair is turned ON. In contrast, when the corresponding Bit is "1" (High level), the other (corresponding to the upper switch in the drawing) of the two analog switches is turned ON. In the drawing, the Bit0 through Bit5 show (111111), the upper switches are turned ON and the lower switches are turned OFF in all switch pairs In this case, the voltages $V_{63}$ is sent to the output circuit 1307 from the D/A converter circuit 1306.

Similarly, for example, when the Bit0 through Bit5 show (111110), the voltages $V_{62}$ is sent to the output circuit 1307 from the D/A converter circuit 1306. When the Bit0 through Bit5 show (000001), the voltages $V_1$ is sent to the output circuit 1307 from the D/A converter circuit 1306, and when the Bit0 through Bit5 show (000000), the voltages $V_0$ is sent to the output circuit 1307 from the D/A converter circuit 1306. Thus, one of the analog voltages ($V_0$ through $V_{63}$) for gradation display-use is selectively outputted in accordance with the digital display so as to realize the gradation display.

In general, the number of the reference voltage generation circuit 1309 in a single source driver IC is one so as to be shared. In contrast, the numbers of the D/A converter circuit 1306 and the output circuit 1307 are respectively one so as to correspond to the respective output terminals 1308 (see FIG. 13).

In the case of the color display, since the output terminals 1308 are used in accordance with the respective colors, the numbers of the D/A converter circuit 1306 and the output circuit 1307 that are used are respectively one for every pixel and for every color. More specifically, when the number of the pixels along the length of the liquid crystal panel 901 is N and the output terminals 1308 for respective red, green, and blue colors are indicated by R, G, and B with suffixes n (n=1, 2, . . . , N), the output terminals 1308 are indicated as $R_1$, $G_1$, $B_1$, $R_2$, $G_2$, $B_2$, . . . , $R_N$, $G_N$, $B_N$. Therefore, the numbers of the required D/A converter circuits 1306 and output circuits 1307 are 3N, respectively.

The following description deals with a variety of circuit configurations of the reference voltage generation circuit 1309, the D/A converter circuit 1306, and the output circuit 1307 with reference to FIGS. 19 through 21.

The circuit configuration shown in FIG. 19 includes the circuit configurations shown in FIGS. 16 and 17. The D/A converter circuit 1306 to which the voltages $V_0$ through $V_{63}$ for gradation display are inputted via the reference voltage generation circuit 1309 selects a voltage for gradation display-use in accordance with the inputted digital display data (an output signal of the level shifter circuit) and outputs the selected voltage to the output circuit 1307.

The output signal of the D/A converter circuit 1306 is sent to the source signal line 1004 in the liquid crystal panel via the output circuit 1307 that acts as a buffer circuit and the output terminal 1308, successively. Note that the reference numeral 1008 in FIG. 19 shows a model of a single pixel in the liquid crystal panel and the wiring capacitance of a source signal line 1004 that is connected with the pixel. Note that the reference numeral 1002 indicates the pixel capacitor, the reference numeral 1003 indicates the TFT, the reference numeral 1006 indicates the electric potential of the opposite electrode, and the reference numeral 1007 indicates the wiring capacitor of the source signal line 1004.

As mentioned above, the circuit configuration shown in FIG. 19, (a) obtains the voltages $V_0$ through $V_{63}$ which are different from each other from the resistor division circuit in which a plurality of resistors are connected in series with each other, (b) selects a voltage among the voltages $V_0$ through $V_{63}$ which corresponds to the digital display data, and (c) outputs via the output circuit 1307 that acts as a buffer circuit the selected voltage that has been subjected to the low impedance so as to charge the wiring capacitance 1007 of the source signal line 1004 and the pixel capacitor 1002 in the liquid crystal panel.

As shown in FIG. 20, it may be possible to remove the output circuit 1307 from the circuit configuration of FIG. 19. In this case, the circuit configuration (a) obtains the voltages $V_0$ through $V_{63}$ which are different from each other from the resistor division circuit in which a plurality of resistors are connected in series with each other, (b) selects a voltage among the voltages $V_0$ through $V_{63}$ which corresponds to the digital display data, and (c) outputs the selected voltage as it is to the source signal line 1004 so as to charge the wiring capacitance 1007 and the pixel capacitor 1002.

As shown in FIG. 21, it may be arranged so that buffer circuits 1310 which correspond to the output circuit 1307 are electrically connected with the reference voltage generation circuit 1309 and the D/A converter circuit 1306, i.e., it may be arranged so that the voltages $V_0$ through $V_{63}$ are sent to the D/A converter circuit 1306 via respective buffer circuits 1310 that correspond to the output circuit 1307. In this case, the voltages $V_0$ through $V_{63}$ are subjected to the low impedance by the respective buffer circuits 1310 and are sent to the D/A converter circuit 1306, and then one of the voltages that corresponds to the digital display data is selected by the analog switches so that the wiring capacitance 1007 and the pixel capacitor 1002 are charged.

In the market of the liquid crystal display apparatus, it is foreseen that (a) the large size of the screen due to the enlargement of the usage of the monitor of the liquid crystal display apparatus and (b) the increase of the pixels due to the high precision rapidly develop. This causes, in especial, each source driver 902 which has many output terminals for liquid crystal driving voltages to be subjected to having further many output terminals. Furthermore, with acceleration, the low cost and the lightweight of the liquid crystal display apparatus cause a single source driver 902 to be subjected to having many outputs of the output terminals for liquid crystal driving voltages (having further many output terminals). For example, it is likely that 1000 output terminals are required (300 output terminals were required for the conventional art).

When coping with the further many output terminals, the circuit configuration of the source driver 902 shown in FIG. 13, in which a low impedance output converter means (output circuit 1307) that adopts a single differential amplifier circuit (operational amplifier circuit) such as a voltage follower circuit for a single output voltage for liquid crystal driving voltage, generally needs many circuit devices of the analog circuit that constitutes the low impedance output converter means This causes the layout area to become large and the operation current for stabling the operation point to become great.

Accordingly, as the output terminals of liquid crystal driving voltages become more and more, the layout area of the output circuit 1307 of the source driver 902 becomes large and the power consumption becomes large. This causes the chip size of the entire source driver IC and the power consumption to become large, respectively.

SUMMARY OF THE INVENTION

The object of the present invention is to provide a display driving apparatus and display apparatus module that are capable of suppressing the increasing in the circuit scale (i.e., the chip size) with the increasing in the number of terminals and the increasing of the power consumption.

In order to achieve the object, a display driving apparatus, in accordance with the present invention, in which a plurality of types of driving voltages that vary depending on display data are outputted to a display section from a plurality of output terminals via a low impedance output section, and is characterized in that (a) each low impedance output section is connected with the plurality of output terminals via a switch section, and (b) the low impedance output section is shared by the plurality of output terminals in response to the switch section.

With the arrangement, a single low impedance output section is connected with a plurality of output terminals via the switch section. The switching operation of the switch section allows that the single low impedance output section is used by the plurality of output terminals. Namely, the single low impedance output section is shared by the plurality of output terminals. Accordingly, when compared with the case where low impedance output sections are provided for respective output terminals, it is possible to suppress the increasing in the circuit scale of the liquid crystal driving apparatus (i.e., the chip size of the case where the liquid crystal driving apparatus is in the form of chip) with the increasing in the number of output terminals and the increasing of the power consumption.

Further, since the low impedance output section is shared, it is possible to avoid that the display unevenness occurs due to the voltage deviation, on the output side, which is caused by the offset voltages at the input stage of differential amplifier circuits, the offset voltages being generated by the unevenness of the factors such as the manufacturing conditions in the respective differential amplifier circuits used as the low impedance output section.

A display apparatus module in accordance with the present invention is characterized by having the above display driving apparatus.

With the arrangement of the display apparatus module, it is possible to suppress the increasing in the circuit scale of the liquid crystal driving apparatus (i.e., the chip size of the case where the liquid crystal driving apparatus is in the form of chip) with the increasing in the number of output terminals and the increasing of the power consumption. Further, since the low impedance output section is shared, it is possible to avoid that the display unevenness occurs due to the voltage deviation, on the output side, which is caused by the offset voltages at the input stage of differential amplifier circuits, the offset voltages being generated by the unevenness of the factors such as the manufacturing conditions in the respective differential amplifier circuits used as the low impedance output section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinafter and the accompanying drawings that are given by way of illustration only, and thus, are not limitative of the present invention.

BRIEF DESCRIPTION OF THE DRAWINGS

FIG. 15(*b*) shows both the present invention and the conventional art and is an explanatory diagram showing one example of the output of the source driver that is applied to the liquid crystal panel shown in FIGS. 2 and 9.

DESCRIPTION OF THE PREFERRED EMBODIMENTS

[First Embodiment]

The following description deals with an embodiment of the present invention with reference to FIGS. 1 through 6.

Figure 2:
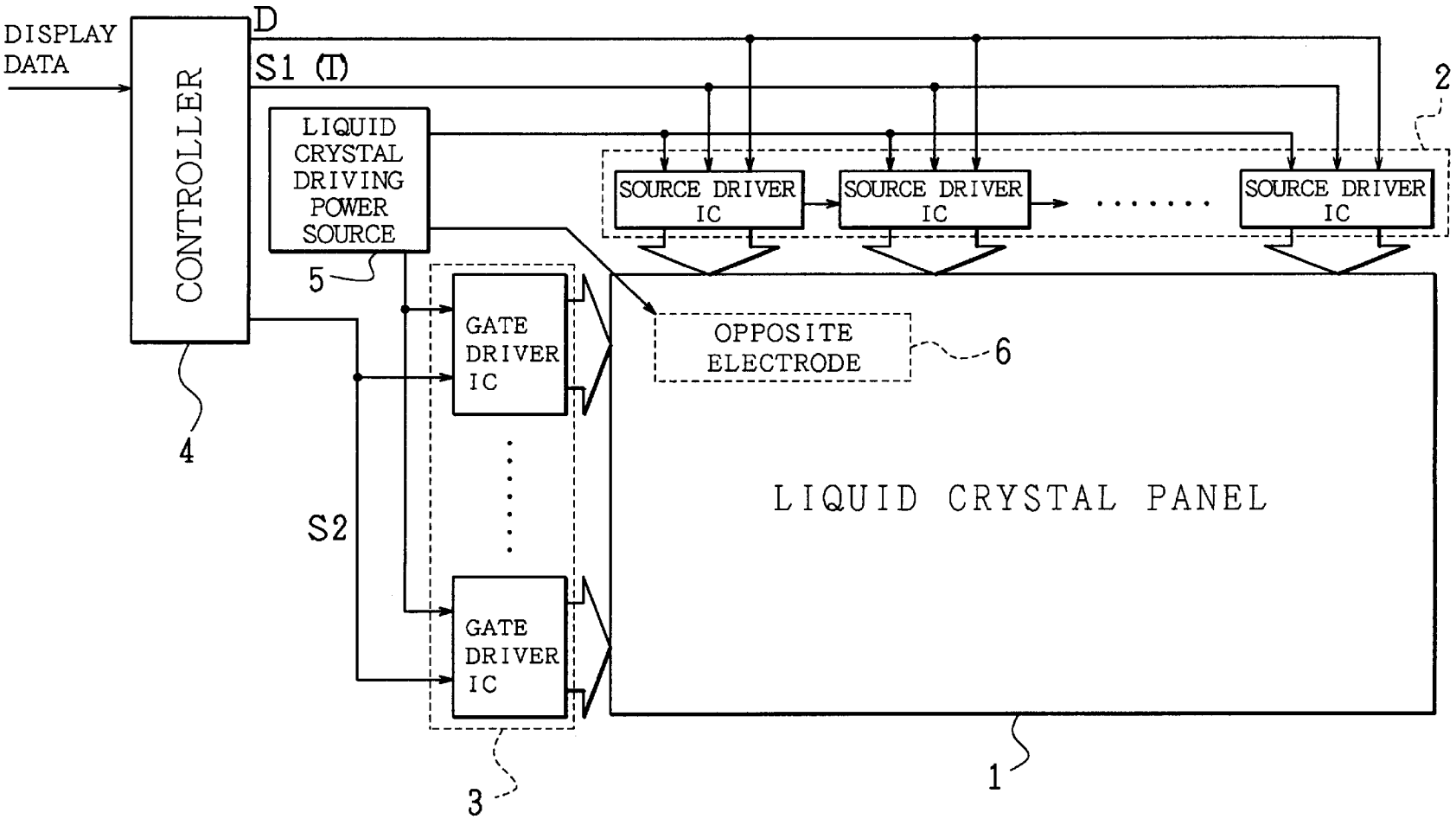
FIG. 2 is a block diagram showing a liquid crystal display apparatus having the source driver shown in FIG. 1.
Figure 13:
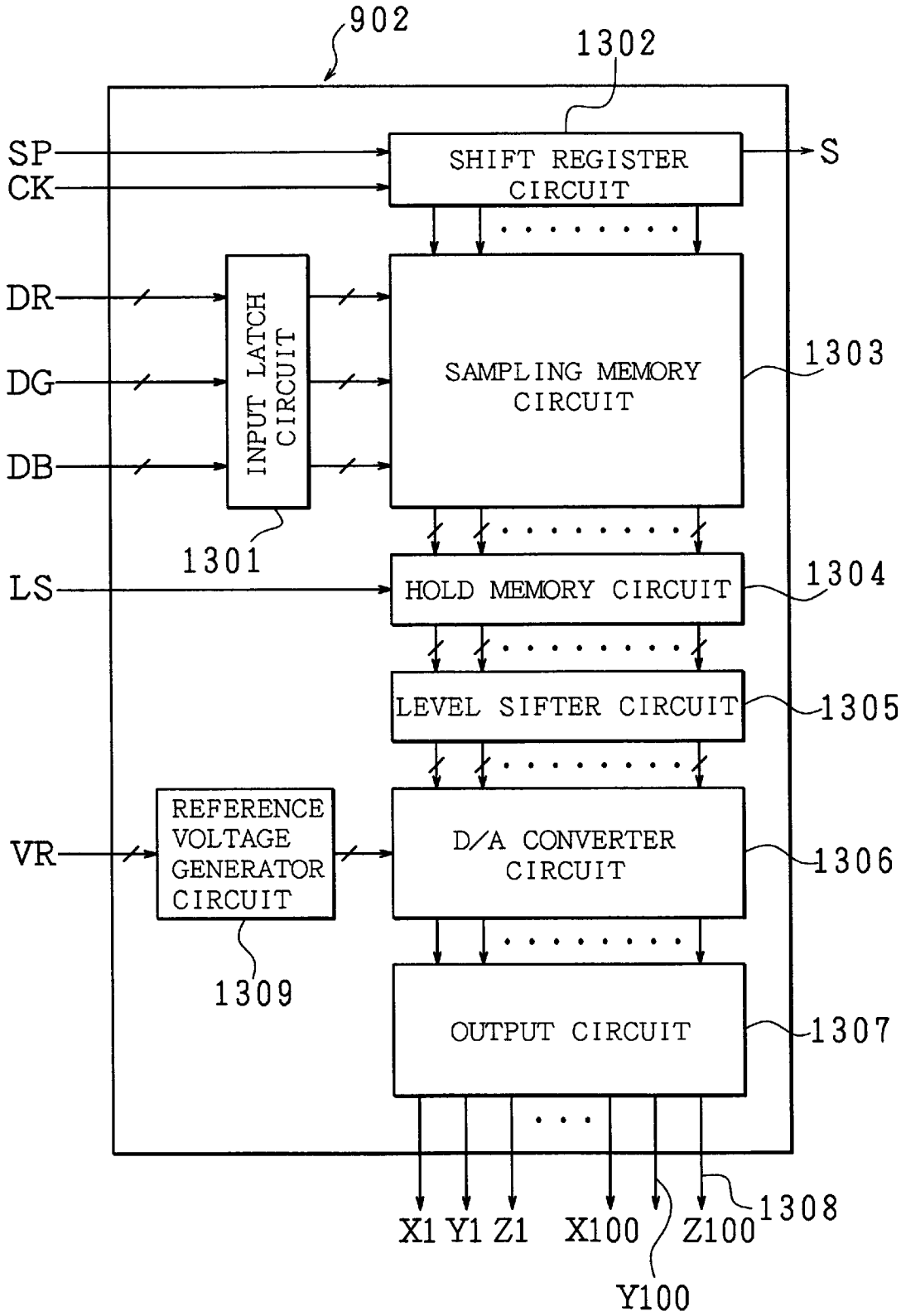
FIG. 13 is a block diagram showing a schematic structure of the source driver shown in FIG. 9.
Figure 14:
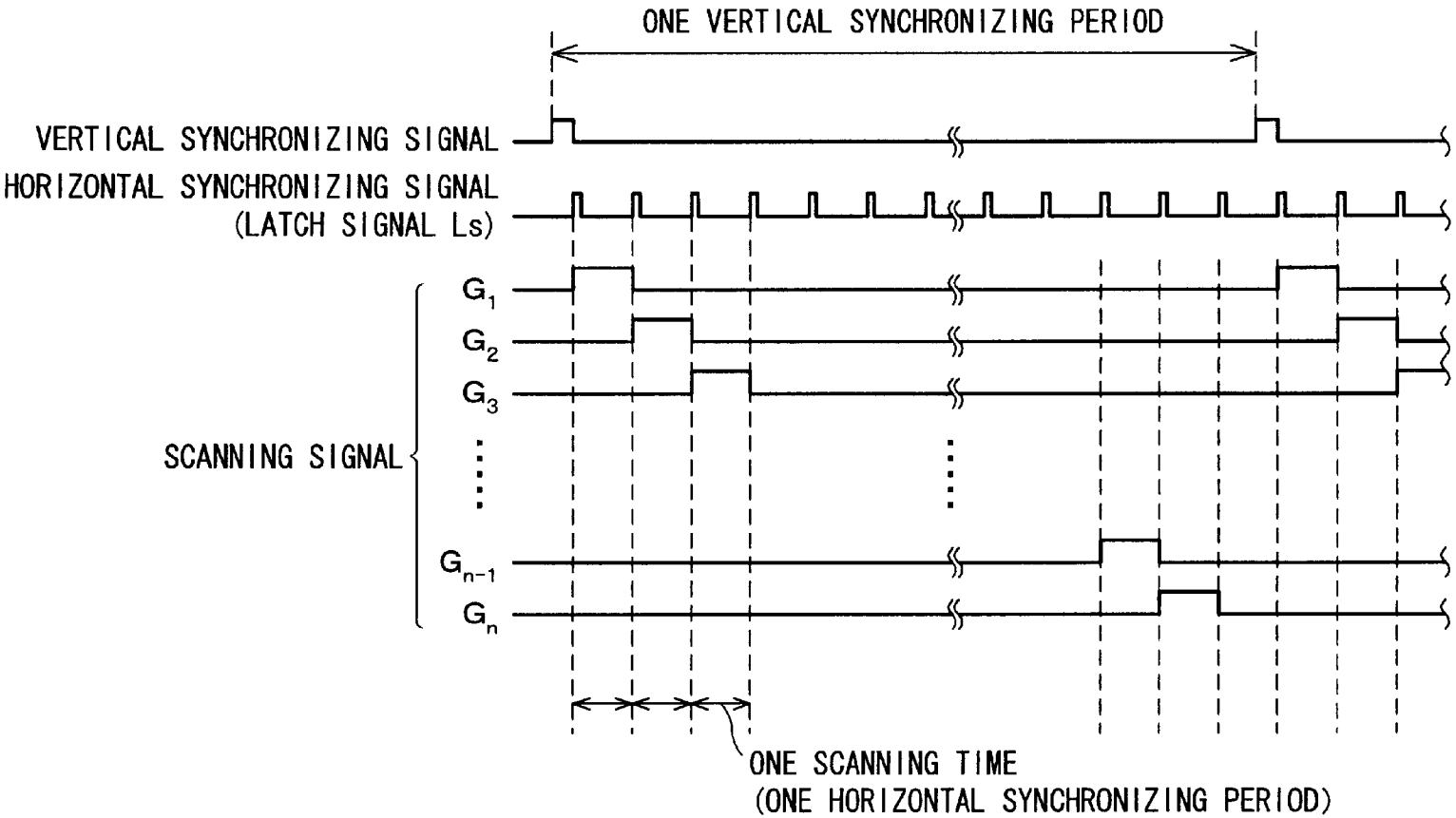
FIG. 14 shows both the present invention and the conventional art and is a timing chart showing one example of the vertical synchronizing signal, the horizontal synchronizing signal, and the scanning signal that are applied to the liquid crystal panel shown in FIGS. 2 and 9.
Figure 15:
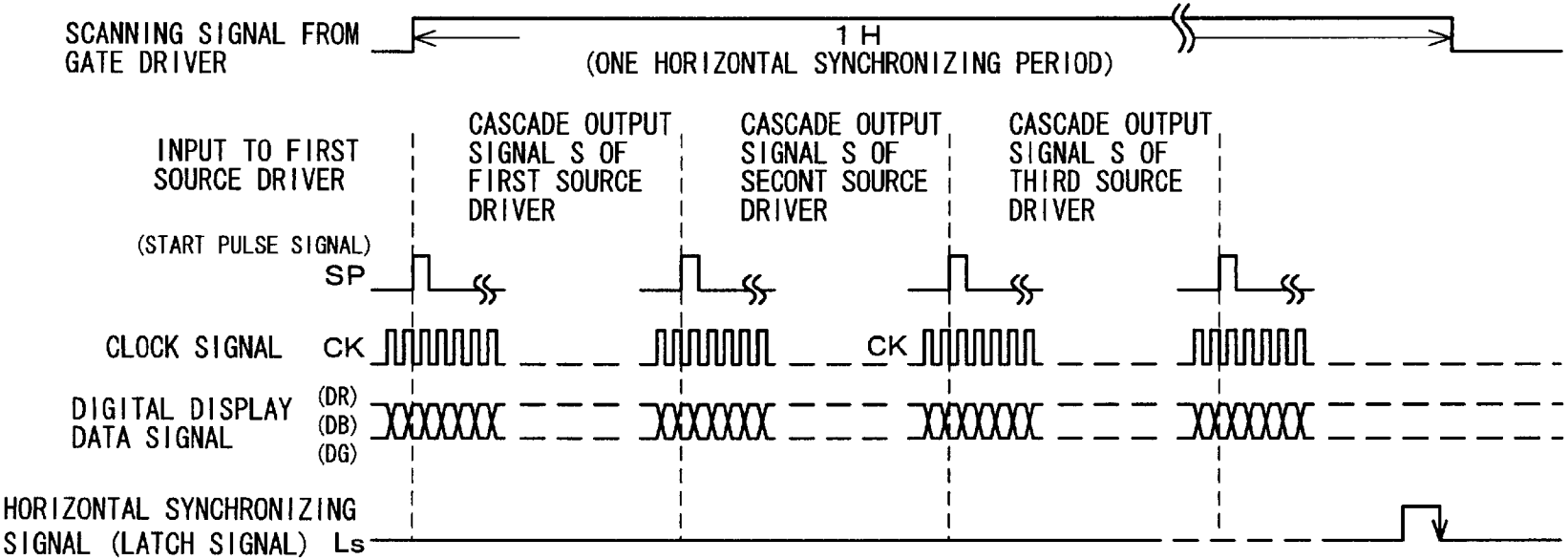
FIG. 15(*a*) shows both the present invention and the conventional art and is a timing chart showing one example of the relation among the scanning signal, the clock signal, the start pulse signal, the digital display data, and the horizontal synchronizing signal that are applied to the liquid crystal panel shown in FIGS. 2 and 9.
Figure 15:
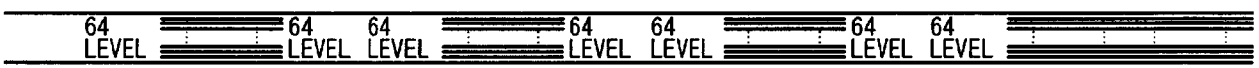
Figure 16:
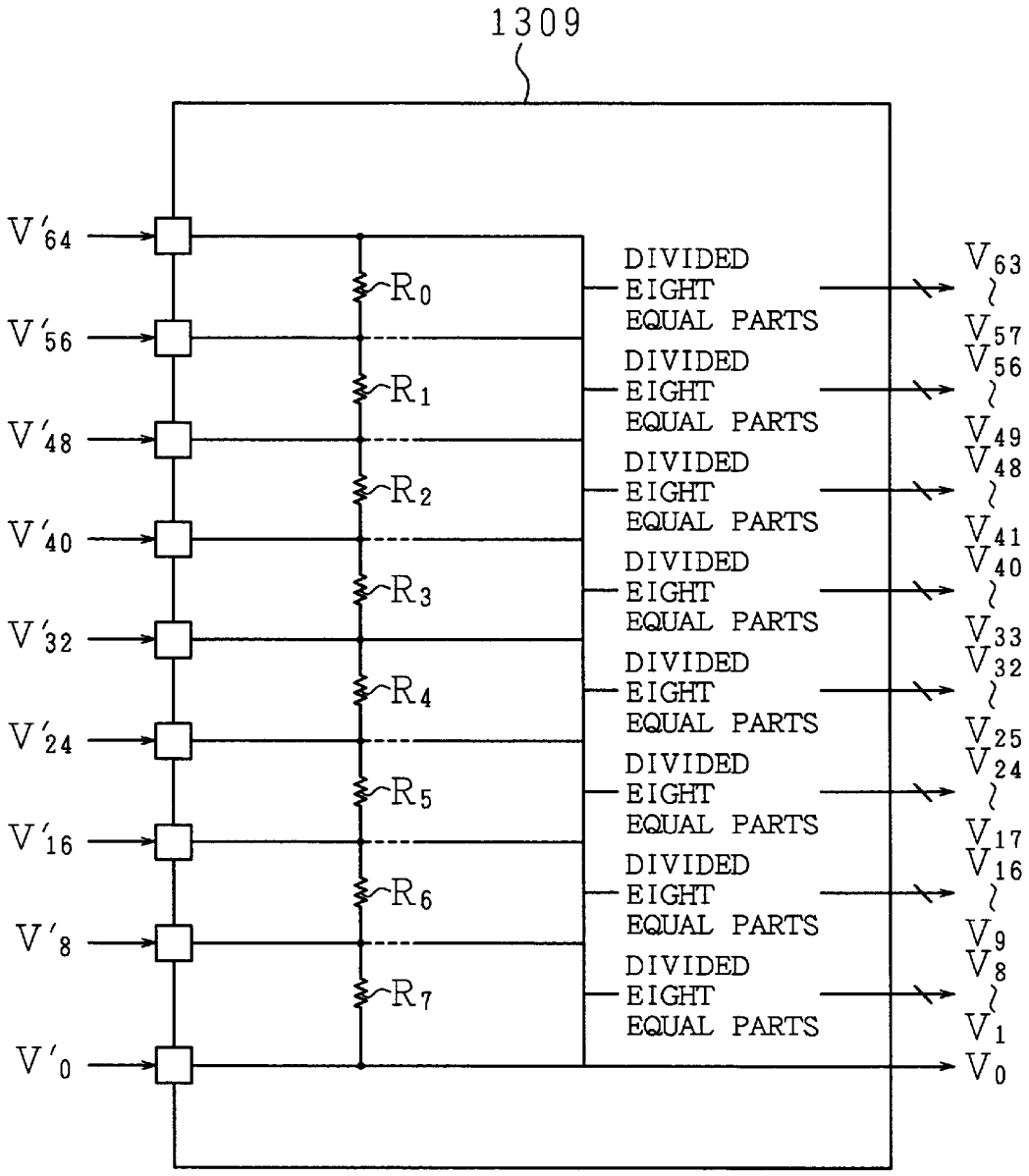
FIG. 16 is an explanatory diagram showing a schematic structure of the reference voltage generation circuit with which the source driver shown in FIG. 9 is provided.
Figure 17:
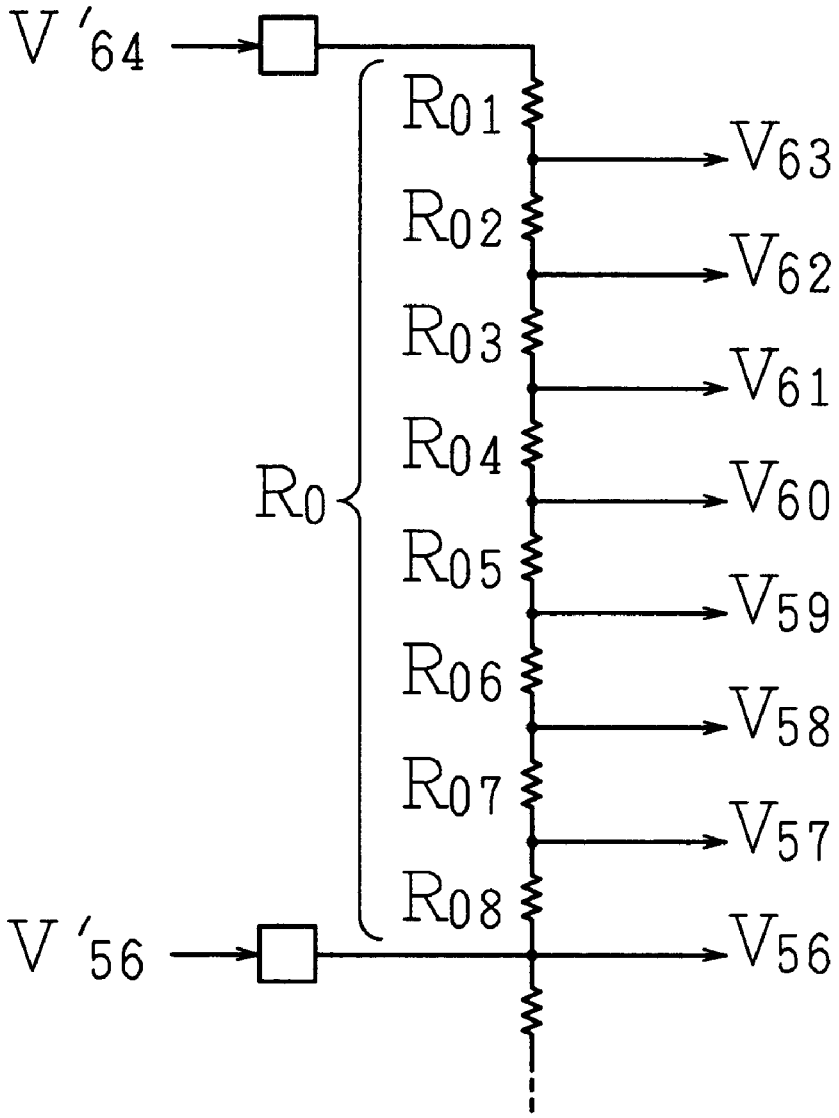
FIG. 17 is a circuit diagram showing the resistor division circuit with which the reference voltage generation circuit shown in FIG. 16 is provided.
Figure 18:
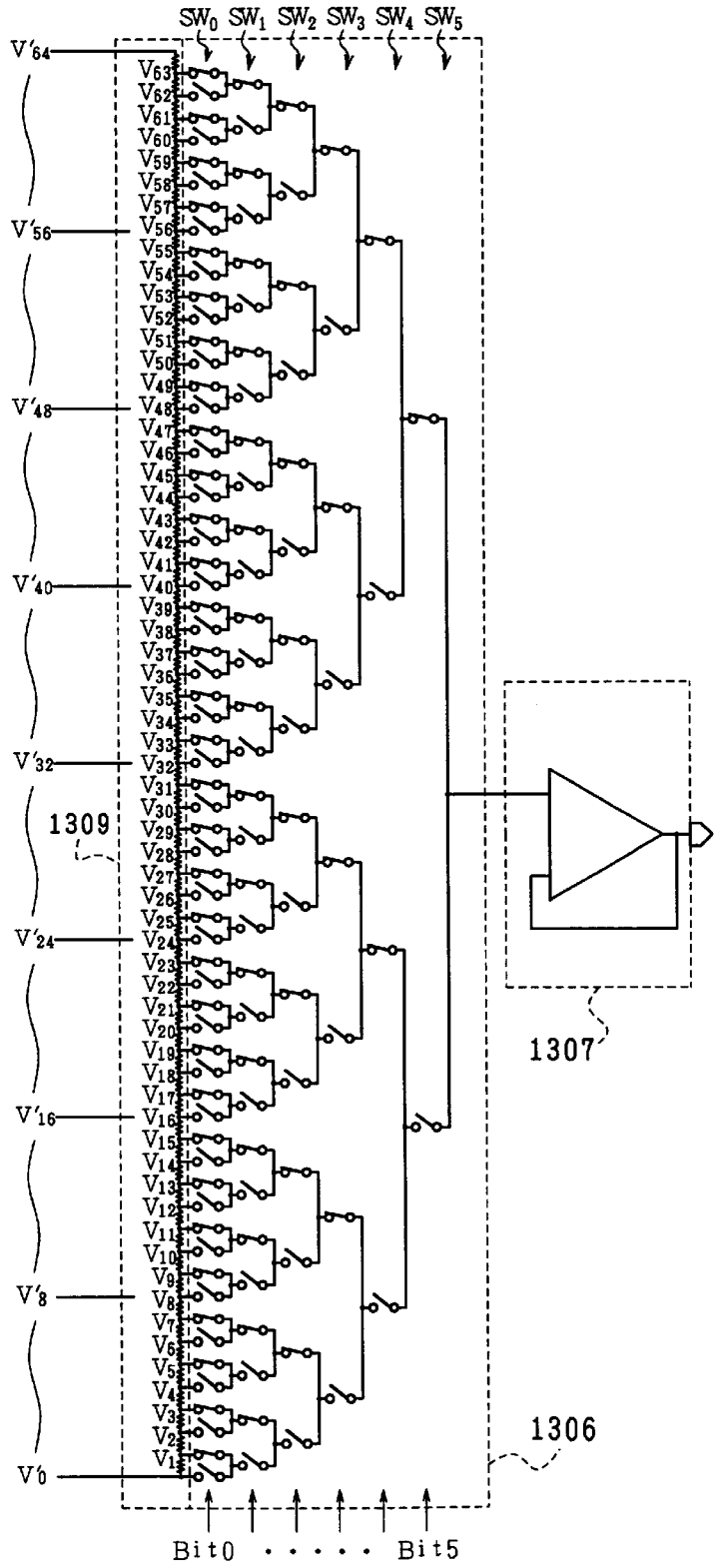
FIG. 18 is an explanatory diagram showing a structure of the reference voltage generation circuit with which the source driver shown in FIG. 9 is provided, the D/A converter circuit, and the output circuit.
Figure 19:
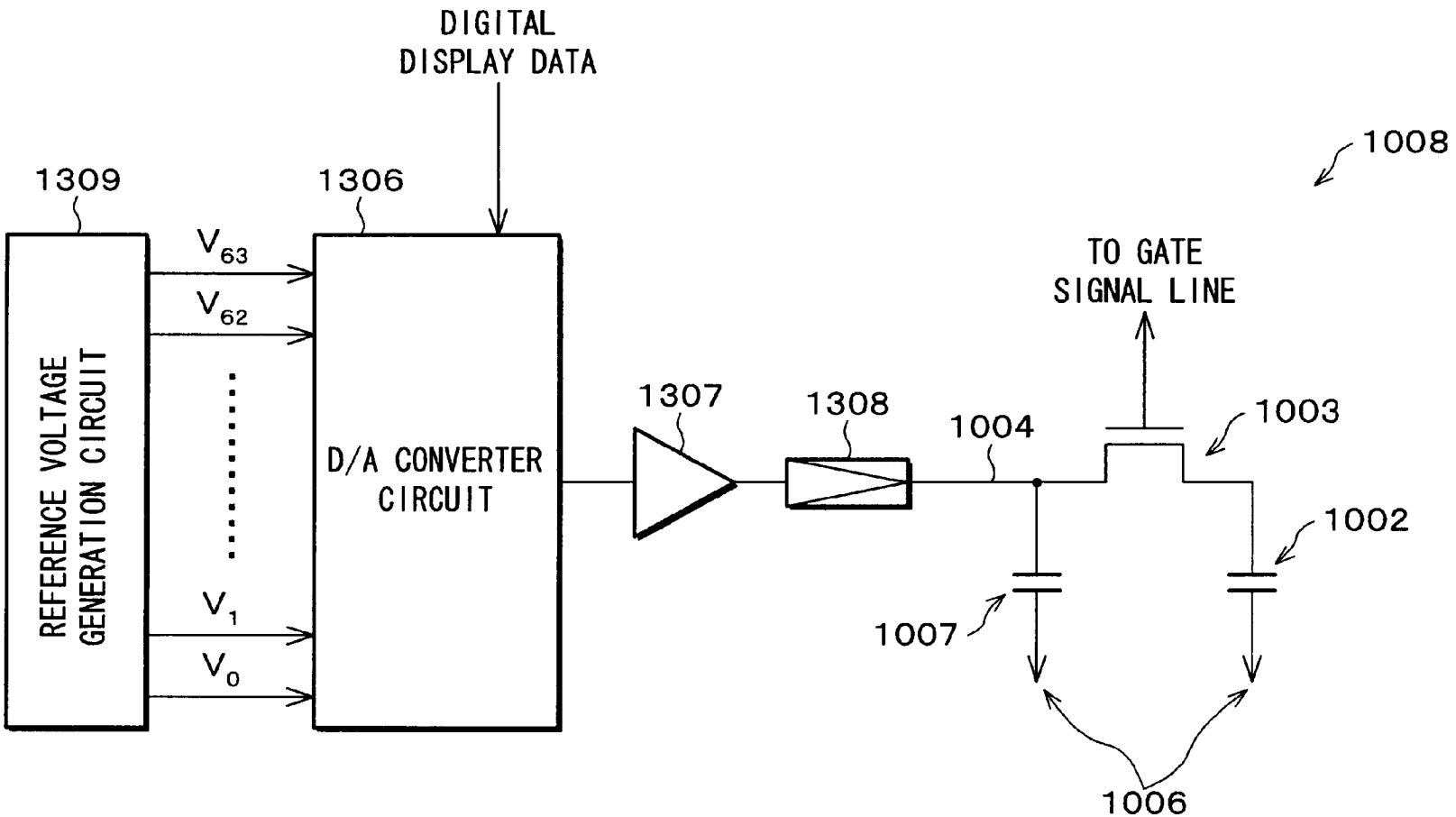
FIG. 19 is an explanatory diagram showing a schematic diagram showing another conventional liquid crystal display apparatus.
Figure 20:
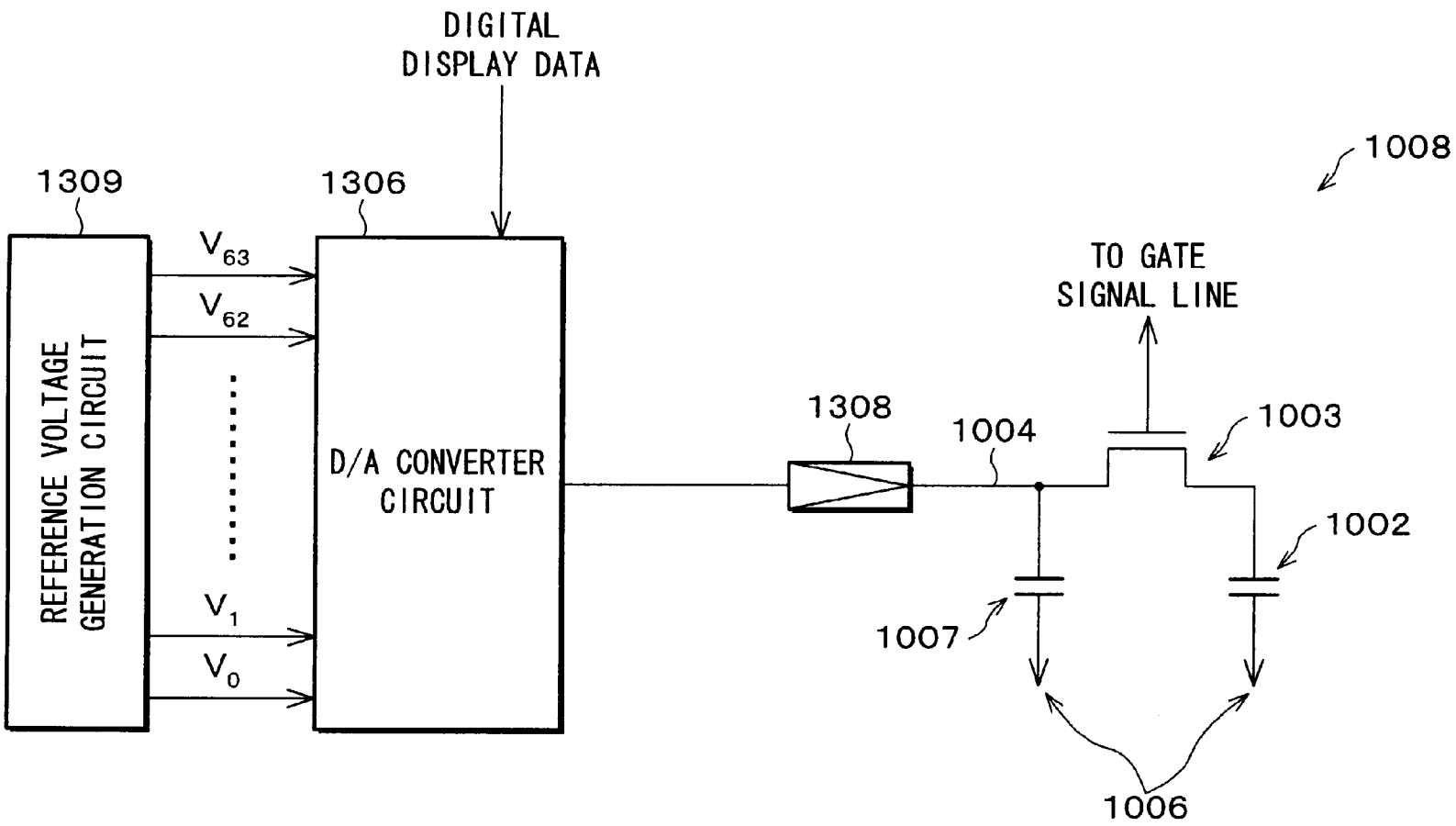
FIG. 20 is an explanatory diagram showing a schematic diagram showing a further conventional liquid crystal display apparatus.
Figure 21:
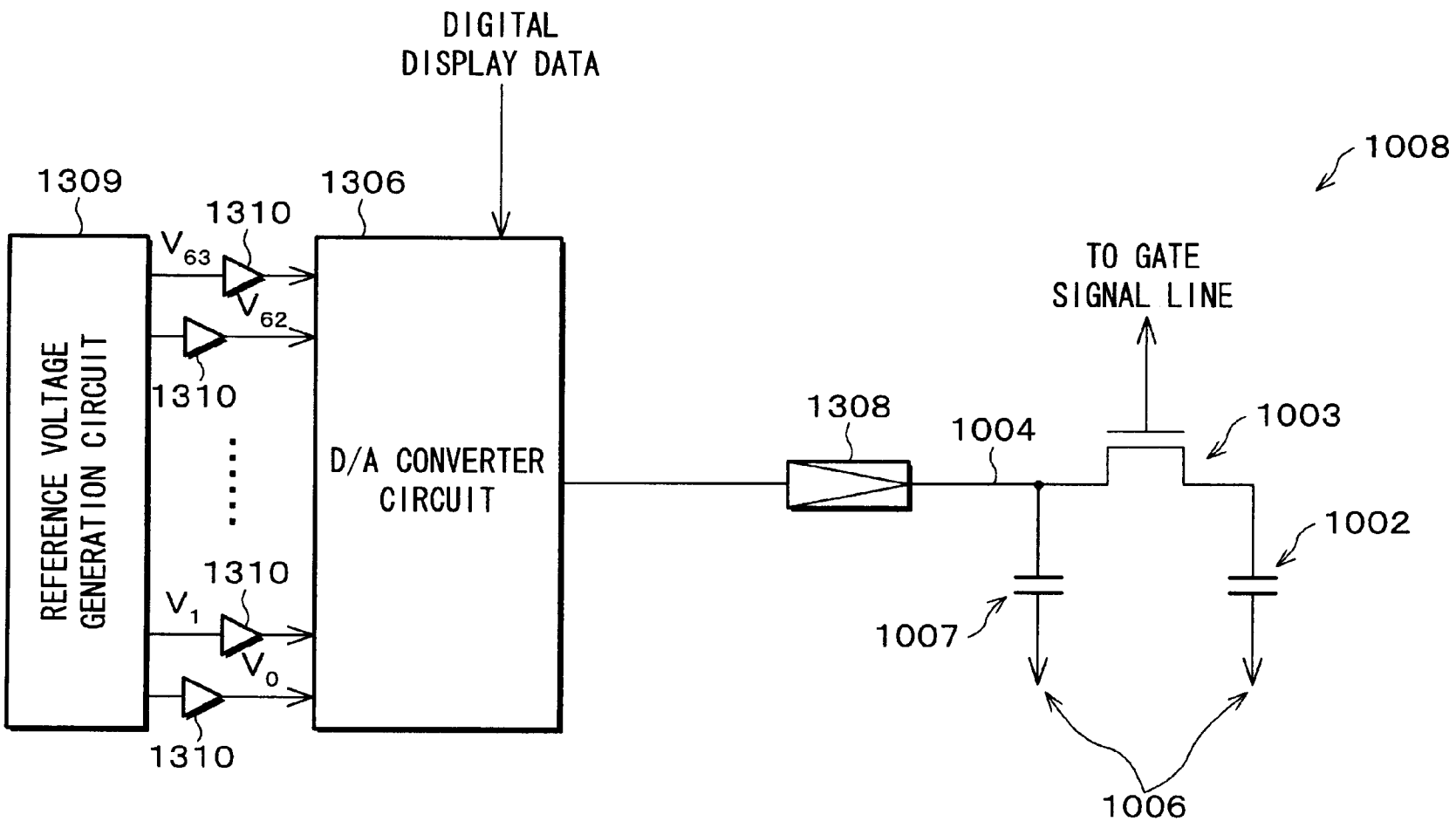
FIG. 21 is an explanatory diagram showing a schematic diagram showing still a further conventional liquid crystal display apparatus.

A liquid crystal display apparatus (display apparatus module) of TFT-type in accordance with the present embodiment, as shown in FIG. 2, is provided with a liquid crystal panel 1 (display means) having an opposite electrode 6, a source driver 2 (display driving apparatus), a gate driver 3, a controller 4, and a liquid crystal driving power source 5. The liquid crystal display apparatus of the present embodiment has the same basic structure and the same driving waveform of the liquid crystal panel 1 as those of the conventional liquid crystal display apparatus shown in FIG. 13. Therefore, the description thereof is omitted here.

The controller 4, like the foregoing controller 904, outputs the display data and a variety of control signals S1 to the source driver 2, and also outputs a variety of control signals S2 to the gate driver 3. Note that the control signals S1 includes a control signal T for a switch control circuit 20 (see FIG. 1) of the source driver 2 that will be later described.

Figure 1:
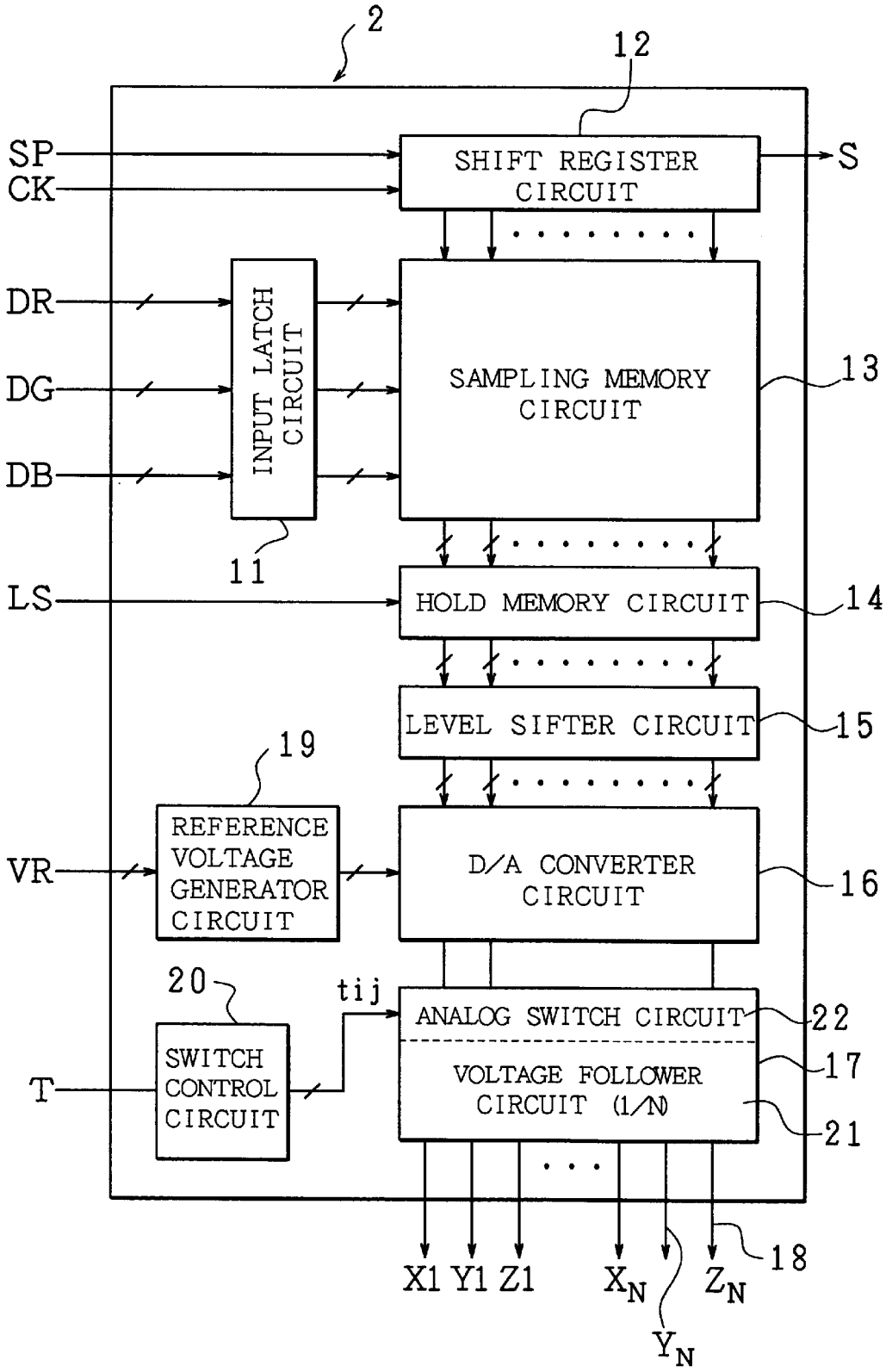
FIG. 1 is a block diagram showing a source driver that acts as a display driving apparatus of one embodiment of the present invention.

The source driver 2, as shown in FIG. 1, is provided with an input latch circuit 11, a shift register circuit 12, a sampling memory circuit 13, a hold memory circuit 14, a level shifter circuit 15, a D/A converter circuit 16 (voltage selection means), an output circuit 17 having output terminals 18 for liquid crystal driving voltages, a reference voltage generation circuit 19 (voltage generation means), and a switch control circuit 20 (switch control means). Among them, the input latch circuit 11, the shift register circuit 12, the sampling memory circuit 13, the hold memory circuit 14, the level shifter circuit 15, the D/A converter circuit 16, and the reference voltage generation circuit 19 have the same circuit configurations as those of FIG. 13, respectively. Therefore, the description thereof is omitted here.

Figure 3:
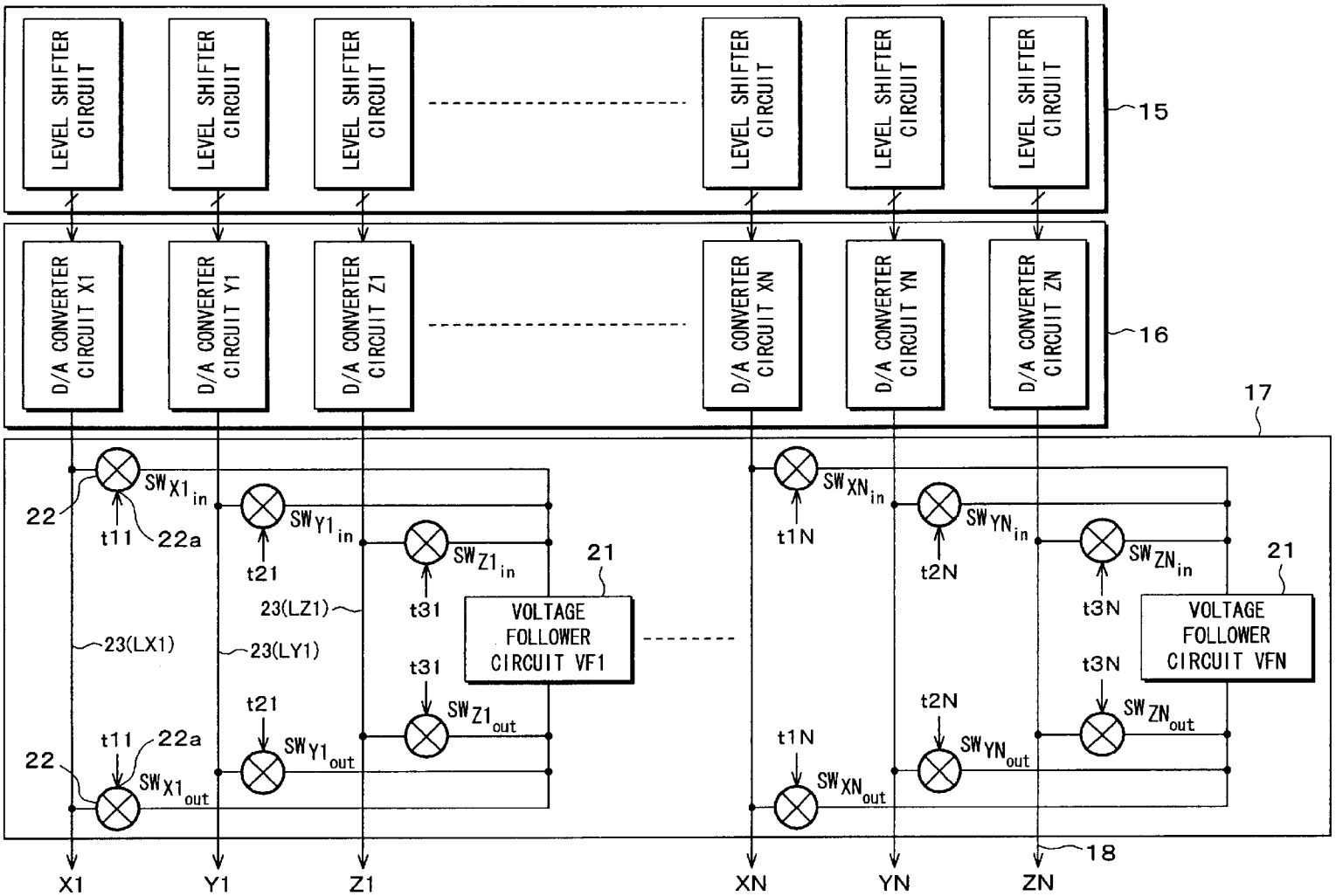
FIG. 3 is a block diagram showing a circuit configuration of the level shifter circuit, the D/A converter circuit, and the output circuit shown in FIG. 1.

In the output circuit 17, as shown in FIG. 3, a single D/A converter circuit 16 is connected with a single output terminal 18 for liquid crystal driving voltage. Each D/A converter circuit 16 selects one of voltage levels for 64-gradataion display-use in accordance with the digital display data (for example, 6-bit data) and sends it to the output circuit 17. A single level shifter circuit 15 is also provided for a single D/A converter circuit 16. These points are similar to those of the foregoing source driver 902 shown in FIG. 13.

Figure 4:
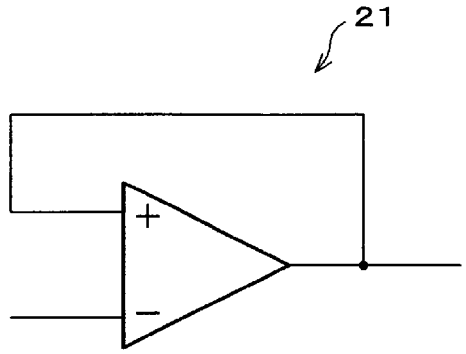
FIG. 4 is a circuit diagram showing the voltage follower shown in FIG. 3.

The output circuit 17, as shown in FIG. 4, is provided with a voltage follower circuit 21 (low impedance output means) that is constituted by a differential amplifier circuit (low impedance output converter means). The voltage follower circuit 21 has a well-known circuit configuration using the already existing technique.

For the brevity of explanation, it is assumed that a single output terminals 18 for liquid crystal driving voltages is provided for every three output terminals 18 for liquid crystal driving voltages, i.e., is shared by the three output terminals 18 for liquid crystal driving voltages that correspond to the respective signals R, G, and B. Thus, N blocks, in each block a single voltage follower circuit 21 is shared by the three output terminals 18 for liquid crystal driving voltages, are provided so as to constitute a single source driver IC (source driver 2). According to the above assumption, when a single source driver 2 has totally 300 output terminals 18 for liquid crystal driving voltages for the respective colors R, G, and B, totally 100 voltage follower circuits 21 are provided, accordingly.

The following description deals with the circuit configuration of the output circuit 17.

In the circuit configuration shown in FIG. 3, D/A converter circuits X1, Y1, Z1 through XN, YN, ZN are provided as the D/A converter circuit 16 so as to correspond to the respective signals R, G, and B, and voltage follower circuits VF1 through VFN are provided as the voltage follower circuit 21. Analog switch circuits SWX1in, SWY1in, SWZ1in, SWX1out, SWY1out, SWZ1out, . . . , SWXNin, SWYNin, SWZNin, SWXNout, SWYNout, SWZNout are provided as the analog switch circuit 22 (switch means). Output terminals X1, Y1, Z1 through XN, YN, ZN are provided as the output terminal 18 for liquid crystal driving voltages. Output lines LX1, LY1, LZ1 through LXN, LYN, LZN are provided as output line 23 that connects the D/A converter circuit 16 with the output terminals 18 for liquid crystal driving voltages.

The analog switch 22 is realized by a MOS transistor, a transmission circuit or other device. This circuit configuration is a well-known circuit configuration using the already existing technique. Each analog switch 22 is provided with a control terminal 22*a* to which a control signal tij (t11, t21, t31 through t1N, t2N, t3N) for controlling the analog switch 22 is applied. The control signal tij is outputted from the switch control circuit 20 in response to a control signal T that is outputted from the controller 4. Here, it is assumed that the switch is turned ON (is conductive) when the control signal tij is a High level and the switch is turned OFF (is nonconductive) when the control signal tij is a Low level.

The output lines LX1, LY1, LZ1 from the respective D/A converter circuits X1, Y1, Z1 which correspond to the signals of the respective R, G, and B are connected, as they are, with the output terminals X1, Y1, Z1 for liquid crystal driving voltages that correspond to the signals of the respective R, G, and B.

Input terminals of the voltage follower circuit VF1 are connected with the D/A converter circuits X1, Y1, Z1 via the analog switch circuits SWX1in, SWY1in, SWZ1in. Output terminals of the voltage follower circuit VF1 are connected with the output terminals X1, Y1, Z1 via the analog switch circuits SWX1out, SWY1out, SWZ1out.

With respect to the analog switch circuits SWX1in and SWX1out, SWY1in and SWY1out, and SWZ1in and SWZ1out, the control signals t11, t21, and t31 for controlling ON/OFF of the respective analog switches are applied from the switch control circuit The above description has dealt with the first block having the voltage follower circuit VF1. The second through the N-th blocks having respective the voltage follower circuits VF2 through VFN have the same circuit configuration as that of the first block.

In the above circuit configuration, the following description deals with the operation of the output circuit 17. Note that for better understanding, the control signal tij is referred to as follows: t11 through t1N are referred to as t1, t21 through t2N are referred to as t2, and t31 through t3N are referred to as t3.

The same signal, i.e., the same voltage for gradation display-use that has been selected in accordance with the digital display data maintains to be successively outputted from each D/A converter circuit 16 based on the latch operation of the hold memory circuit 14 in a horizontal synchronizing signal (1H period (duration)) shown in FIG. 3 of the liquid crystal display apparatus.

The horizontal synchronizing signal (the latch signal Ls of FIG. 1) is applied to the source driver 2, and the gradation voltage is selected in accordance with the digital display data by the D/A converter circuit 16. When the gradation voltage thus selected is outputted to the output circuit 17, the control signal t1 that is outputted from the switch control circuit 20 becomes High level. This causes the analog switch circuits SWX1in and SWXNout (i=1 through N) to be turned ON (conductive). At this time, the analog switch circuits SWYjin and SWYjout (j=1 through N) and the analog switch circuits SWZkin and SWZkout (k=1 through N) are turned OFF (nonconductive).

Accordingly, (a) the voltages that are directly outputted from the D/A converter circuits X1 through XN via the respective output lines LX1 through LXN and (b) the output voltages of the respective D/A converter circuits VF1 through VFN whose output resistors have been subjected to the low impedance are outputted from the respective output terminals X1 through XN for liquid crystal driving voltages.

Figure 10:
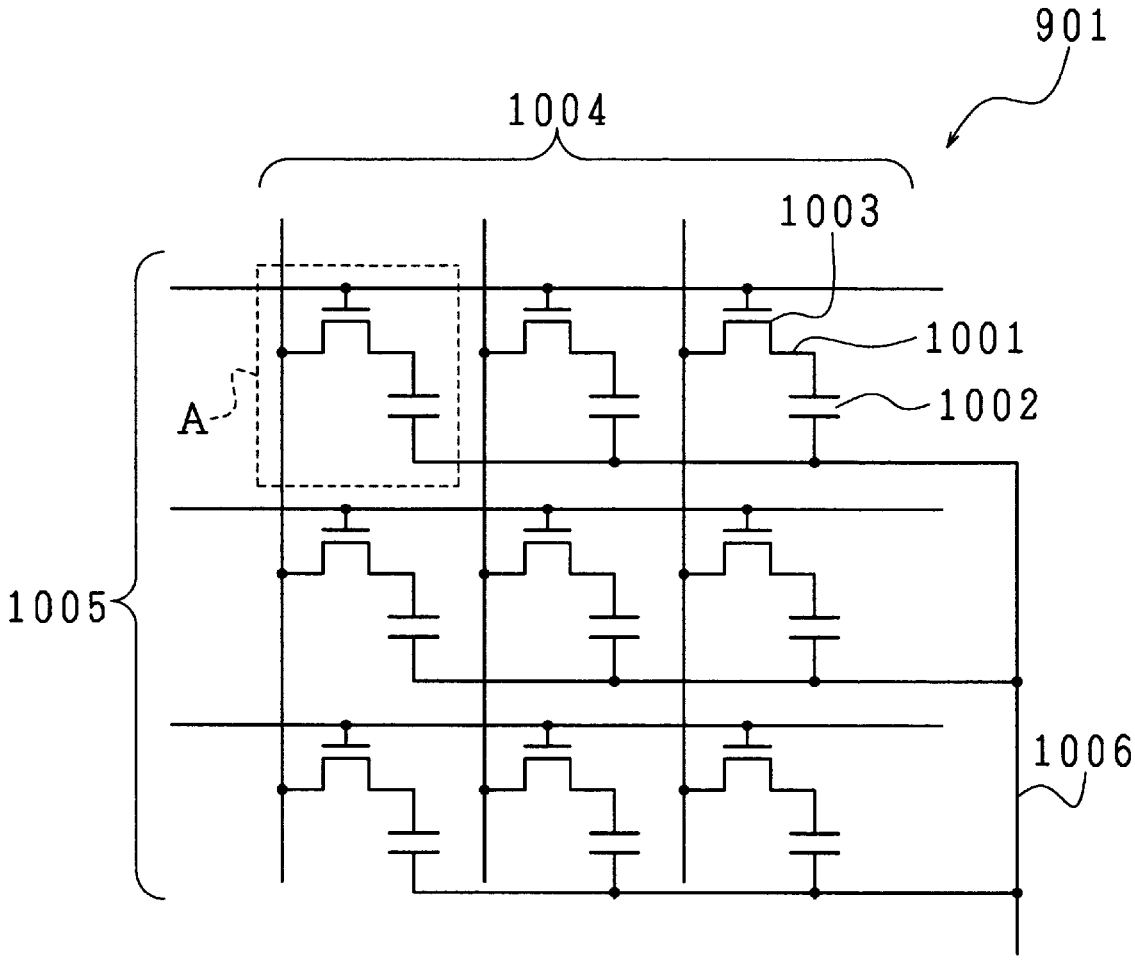
FIG. 10 shows both the present invention and the conventional art and is a circuit diagram showing a schematic structure of the liquid crystal panel shown in FIGS. 2 and 9.
Figure 11:
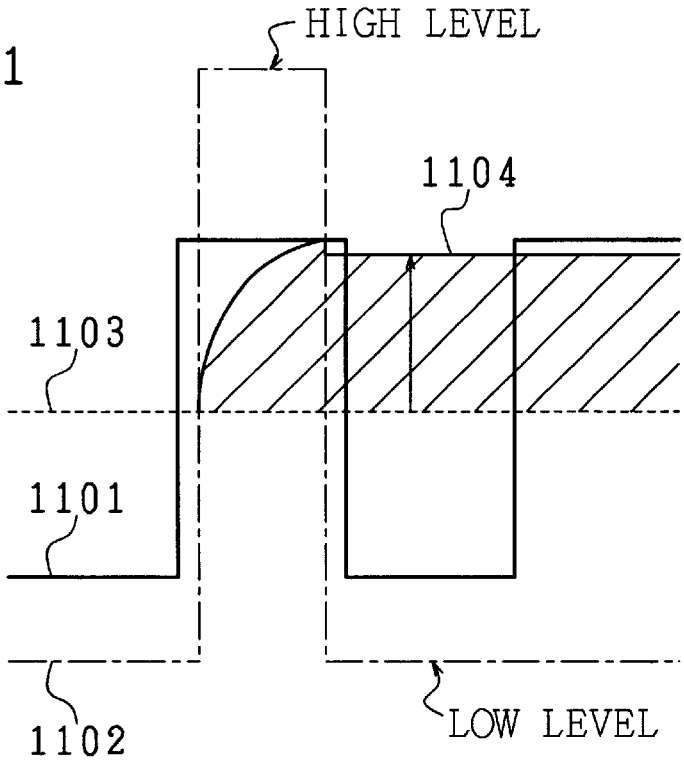
FIG. 11 shows both the present invention and the conventional art and is one example of the liquid crystal driving waveform in the liquid crystal display apparatus shown in FIGS. 2 and 9.
Figure 12:
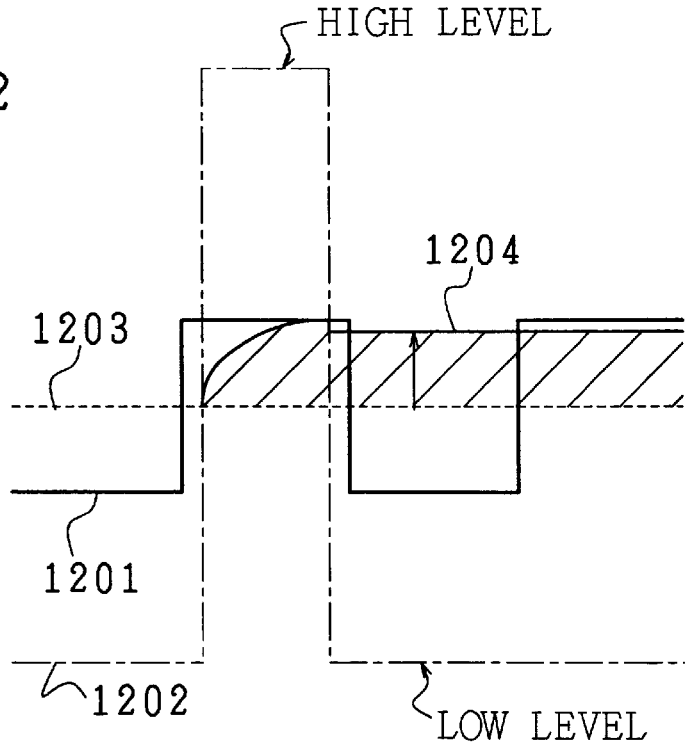
FIG. 12 shows both the present invention and the conventional art and is another example of the liquid crystal driving waveform shown in FIG. 11.

With the circuit configuration, in the pixels in which the source signal lines 1004 (see FIG. 10) are connected with the respective output terminals X1 through XN for liquid crystal driving voltages and which are selected by the scanning signal of the gate driver 3, i.e., in the pixels in which the High level is applied to the gate signal line 1005 of the TFT 1003 and the TFT 1003 is turned ON, the pixel capacitors 1002 are charged and discharged mainly via the respective voltage follower circuits VF1 through VFN. This ensures that the voltage across the pixel capacitor 1002 rapidly reaches a target voltage for gradation display-use.

When the charging and discharging are completed with respect to the pixel capacitor 1002 and the voltage across the pixel capacitor 1002 reaches the target voltage for gradation display-use, the control signal t1 from the switch control circuit 20 becomes Low level, so that the analog switch circuits SWX1in and SWXNout (i=1 through N) are turned OFF (nonconductive).

With the operation, the outputting via the voltage follower circuits VF1 through VFN with respect to the source signal lines 1004 with which the output terminals X1 through XN are connected respectively are cut off by the analog switch circuits SWX1in and SWXNout (i=1 through N). Accordingly, thereafter, the signals to be applied to the source signal lines 1004 are switched to the signals that are directly outputted from the D/A converter circuits X1 through XN via the output lines LX1 through LXN, until the next control signal t1 becomes High level. In this case, the respective output terminals X1 through XN for liquid crystal driving voltages become in a high impedance output state. However, such a state is enough to maintain the voltages of the source signal lines 1004 after the charging and discharging of the pixel capacitors 1002 are completed.

When the control signal t2 that is outputted from the switch control circuit 20 changes to High level from Low level, the analog switch circuits SWYjin and SWYjout (j=1 through N) are turned ON (conductive). At this time, the analog switch circuits SWX1in and SWXiout (i=1 through N) are turned OFF (nonconductive), and the analog switch circuits SWZkin and SWZkout (k=1 through N) are turned OFF (nonconductive).

Accordingly, (a) the voltages that are directly outputted from the D/A converter circuits Y1 through YN via the respective output lines LY1 through LYN and (b) the output voltages of the respective D/A converter circuits VF1 through VFN whose output resistors have been subjected to the low impedance are outputted from the respective output terminals Y1 through YN for liquid crystal driving voltages.

With the circuit configuration, in the pixels in which the source signal lines 1004 are connected with the respective output terminals Y1 through YN for liquid crystal driving voltages and which are selected by the scanning signal of the gate driver 3, i.e., in the pixels in which the High level is applied to the gate signal line 1005 of the TFT 1003 and the TFT 1003 is turned ON, the pixel capacitors 1002 are charged and discharged mainly via the respective voltage follower circuits VF1 through VFN. This ensures that the voltage across the pixel capacitor 1002 rapidly reaches a target voltage for gradation display-use.

When the charging and discharging are completed with respect to the pixel capacitor 1002 and the voltage across the pixel capacitor 1002 reaches the target voltage for gradation display-use, the control signal t2 from the switch control circuit 20 becomes Low level, so that the analog switch circuits SWYjin and SWYjout (j=1 through N) are turned OFF (nonconductive).

With the operation, the outputting via the voltage follower circuits VF1 through VFN with respect to the source signal lines 1004 with which the output terminals Y1 through YN are connected respectively are cut off by the analog switch circuits SWYjin and SWYjout (j=1 through N). Accordingly, thereafter, the signals to be applied to the source signal lines 1004 are switched to the signals that are directly outputted from the D/A converter circuits Y1 through YN via the output lines LY1 through LYN, until the next control signal t2 becomes High level. In this case, the respective output terminals Y1 through YN for liquid crystal driving voltages become in a high impedance output state. However, such a state is enough to maintain the voltages of the source signal lines 1004 after the charging and discharging of the pixel capacitors 1002 are completed.

Then, the control signal t3 that is outputted from the switch control circuit 20 changes to High level from Low level. This allows the following. More specifically, like the foregoing, in the pixels in which the source signal lines 1004 are connected with the respective output terminals Z1 through ZN for liquid crystal driving voltages and which are selected by the scanning signal of the gate driver 3, i.e., in the pixels in which the High level is applied to the gate signal line 1005 of the TFT 1003 and the TFT 1003 is turned ON, the pixel capacitors 1002 are charged and discharged mainly via the respective voltage follower circuits VF1 through VFN. This ensures that the voltage across the pixel capacitor 1002 rapidly reaches a target voltage for gradation display-use.

When the charging and discharging are completed with respect to the pixel capacitor 1002 and the voltage across the pixel capacitor 1002 reaches the target voltage for gradation display-use, the control signal t3 from the switch control circuit 20 becomes Low level, so that the analog switch circuits SWZkin and SWZkout (k=1 through N) are turned OFF (nonconductive). Thus, a series of operations are completed in one horizontal synchronizing period. Subsequently, the similar operations are repeated in the next horizontal synchronizing period.

Note that the switch control circuit 20 may be realized by an already existing well-known circuit configuration. For example, the switch control circuit 20 may be realized by a shift register so as to successively output the control signals t1, t2, and t3 in synchronization with the control signal T outputted from the controller 4. Alternatively, the switch control circuit 20 may be realized by a selection circuit, provided that the control signal T is realized by command signals that are inputted in a serial manner or in a parallel manner, so that the control signals t1, t2, and t3 are selected in accordance with the command signals.

As has been described, according to the present liquid crystal display apparatus, three output terminals 18 (X, Y, Z) for liquid crystal driving voltages, i.e., the three outputs for the respective R, G, and B share a single voltage follower circuit 21. This ensures (a) to reduce the size of the output circuit 17, i.e., the chip size of the source driver 2 and (b) to realize the low power consumption. Further, it is possible to rapidly charge and discharge the target voltage for gradation display-use, thereby causing no problem on the animation display.

Further, when the charging and discharging are completed with respect to the pixel capacitor 1002 and the voltage follower circuit 21 is cut off from the output line 23 (i.e., the source signal line 1004), it is kept to send the output signal to the source signal line 1004 from the D/A converter circuit 16. Accordingly, in the voltage follower circuit 21 that is constituted by the differential amplifier circuits, even when the voltage deviation occurs on the output side due to the offset voltages of the input stage of the differential amplifier circuits that are generated by the unevenness of the factors such as the manufacturing conditions, it is possible to eliminate the deviation. This ensures to reduce the occurrence of the display unevenness.

Note that the present embodiment deals with the case where three output terminals Xi, Yi, and Zi (i=1 through N)

for liquid crystal driving voltages share a single voltage follower circuit 21. However, the present invention is not limited to this. Namely, any plurality of output terminals 18 (i.e., arbitrary number of output terminals 18) for liquid crystal driving voltages (N output terminals (N: natural number)) may share a single voltage follower circuit 21. The output terminals 18 for liquid crystal driving voltages that share a single voltage follower circuit 21 may be freely combined with each other. Alternatively, a single output circuit 17, i.e., the source driver 2 may be arranged so as to share a single voltage follower circuit 21.

Further, the control signals (t11, t21, t31), (t12, t22, t32), . . . , (t1N, t2N, t3N) for controlling the ON/OFF of the analog switch circuit 22 may be control signals which are different from each other. In this case, when the background part of the screen is not changed like the case where the window display (display in part on the screen) is carried out in a liquid crystal display screen, for example, if the analog switch circuit 22 of the output terminals 18 for liquid crystal driving voltages is arranged so as to maintain to be turned OFF as long as the display is not affected, it is possible to reduce the power consumption of the analog switch circuit 22 in the output circuit 17 during the switching.

Alternatively, the timing at which each turn-ON starts may be shifted among the analog switch circuits (SWX1in, SWX1out) through (SWXNin, SWXNout), by shifting the timing of each rising of the control signals t11 through t1N, for example. This is the case among the analog switch circuits (SWY1in, SWY1out) through (SWYNin, SWYNout) and the analog switch circuits (SWZ1in, SWZ1out) through (SWZNin, SWZNout). In this case, since the start points, at which the maximum current flows, of the charging and discharging with respect to the pixel capacitances are shifted among the respective pixel capacitors 1002, it is possible to avoid that the peaks of the consumed currents concentrate. This arrangement is effective for the portable usages in which the battery driving is carried out.

Figure 6:
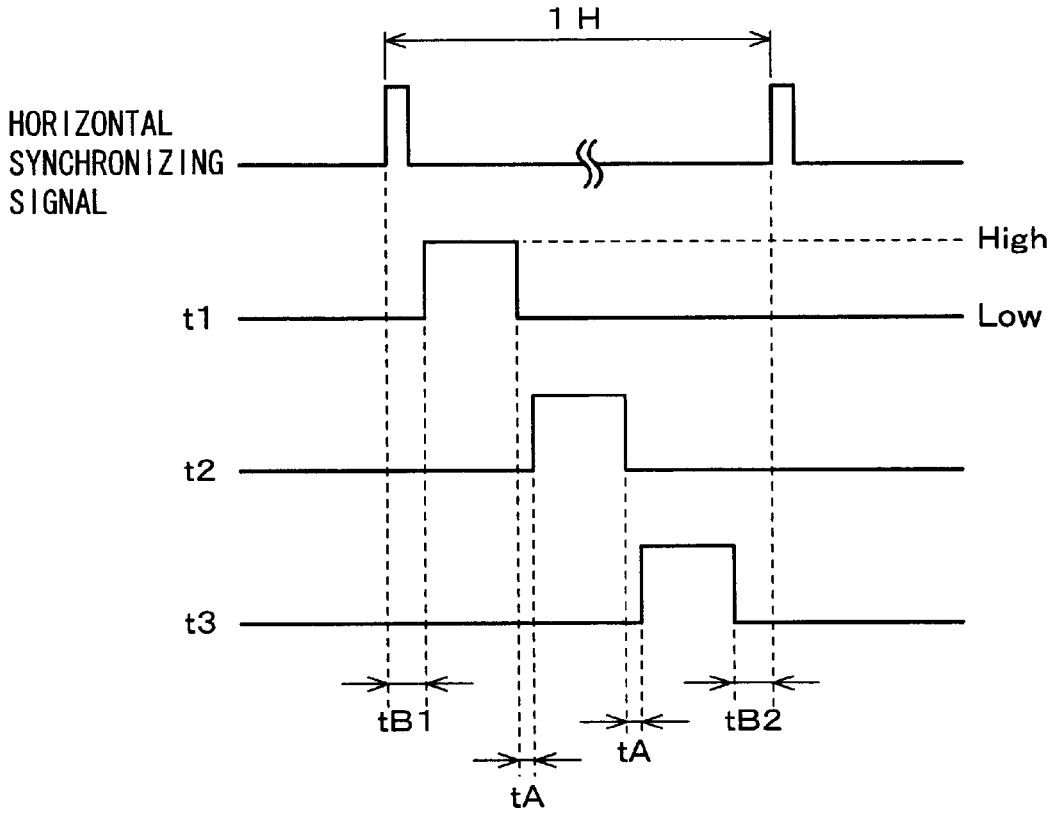
FIG. 6 is a timing chart showing the control signal t1 through t3, the control signals t2 and t3 whose timings are different from those of FIG. 5, and the horizontal synchronizing signal.

As shown in FIG. 6, by providing a period tA between the ON-period of the control signal t1 and the ON-period of the control signal t2 and another period tA between the ON-period of the control signal t2 and the ON-period of the control signal t3, the period (the period tA), in which all the analog switch circuits 22 are turned OFF during the switching of the analog switch circuit 22 to be turned ON, may be secured. In this case, during the switching of the analog switch circuit 22 to be turned ON, it is possible to avoid that (a) the analog switch circuit 22 that has been turned ON and (b) the analog switch circuit 22 to be turned ON next are both turned ON so as to supply the source signal lines 1004, that are not the target source signal lines, with the output signal of the voltage follower circuit 21.

Note that the period in which the analog switch circuits 22 are simultaneously turned OFF may be the entire one horizontal synchronizing period (1H) If the charging and discharging with respect to the pixel capacitor 1002 are rapidly completed, a period (period tB2), in which all the analog switch circuits 22 are turned OFF, may be secured. In this case, since only the D/A converter circuit 16 maintains to output the output signal to the source signal line 1004 after the analog switch circuits 22 are turned OFF, it is possible to further eliminate, in the voltage follower circuit 21 which is constituted by differential amplifier circuits, the occurrence of the voltage deviation on the output side due to the offset voltages of the input stage of the differential amplifier circuits that are generated by the unevenness of the factors such as the manufacturing conditions.

Figure 5:
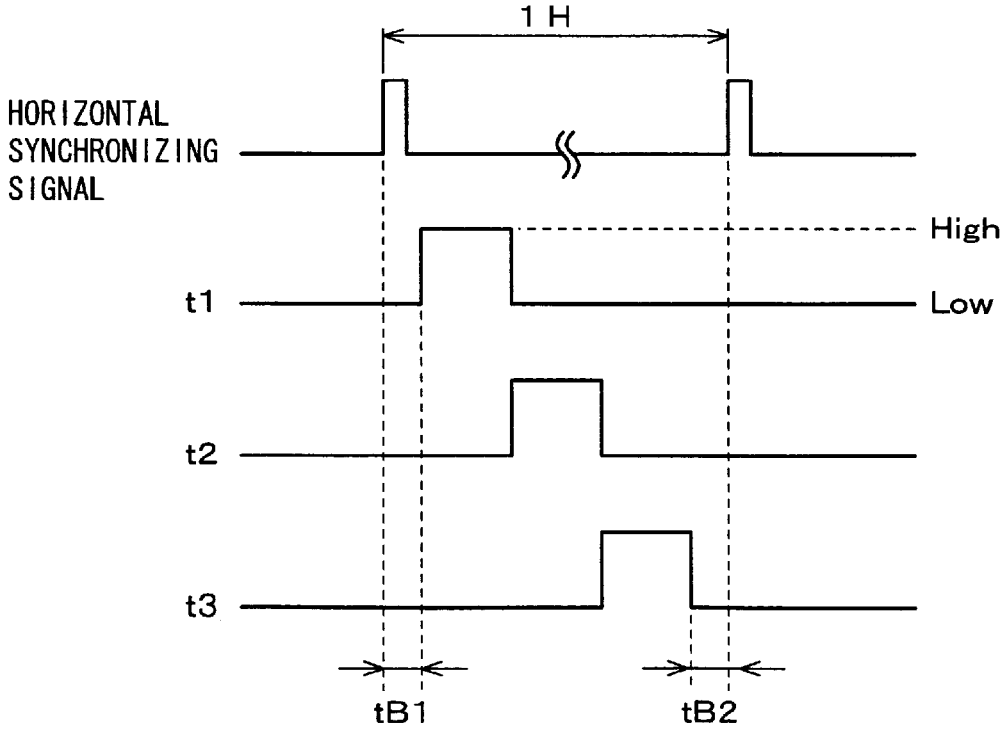
FIG. 5 is a timing chart showing the control signals t1 through t3 and the horizontal synchronizing signal that are sent to the analog switch circuit of the output circuit from the switch control circuit shown in FIG. 1.

Further, as shown in FIG. 5, the start point for switching the analog switch circuit 22 (the rising of the control signal t1) may be arbitrary with respect to the horizontal synchronizing signal. For example, the start point may be delayed for a period tB1 with respect to the start point of one horizontal synchronizing period of the horizontal synchronizing signal.

In addition, the present embodiment deals with the case where the voltage follower circuit 21 is used as the low impedance output conversion means. However, the present invention is not limited to this. Non-inverted amplifier circuit may be substituted therefor. In this case, since the voltage for gradation display-use is amplified by the output circuit 17, it is possible to remove the level shifter circuit 15 in the source driver 2.

[Second Embodiment]

Figure 7:
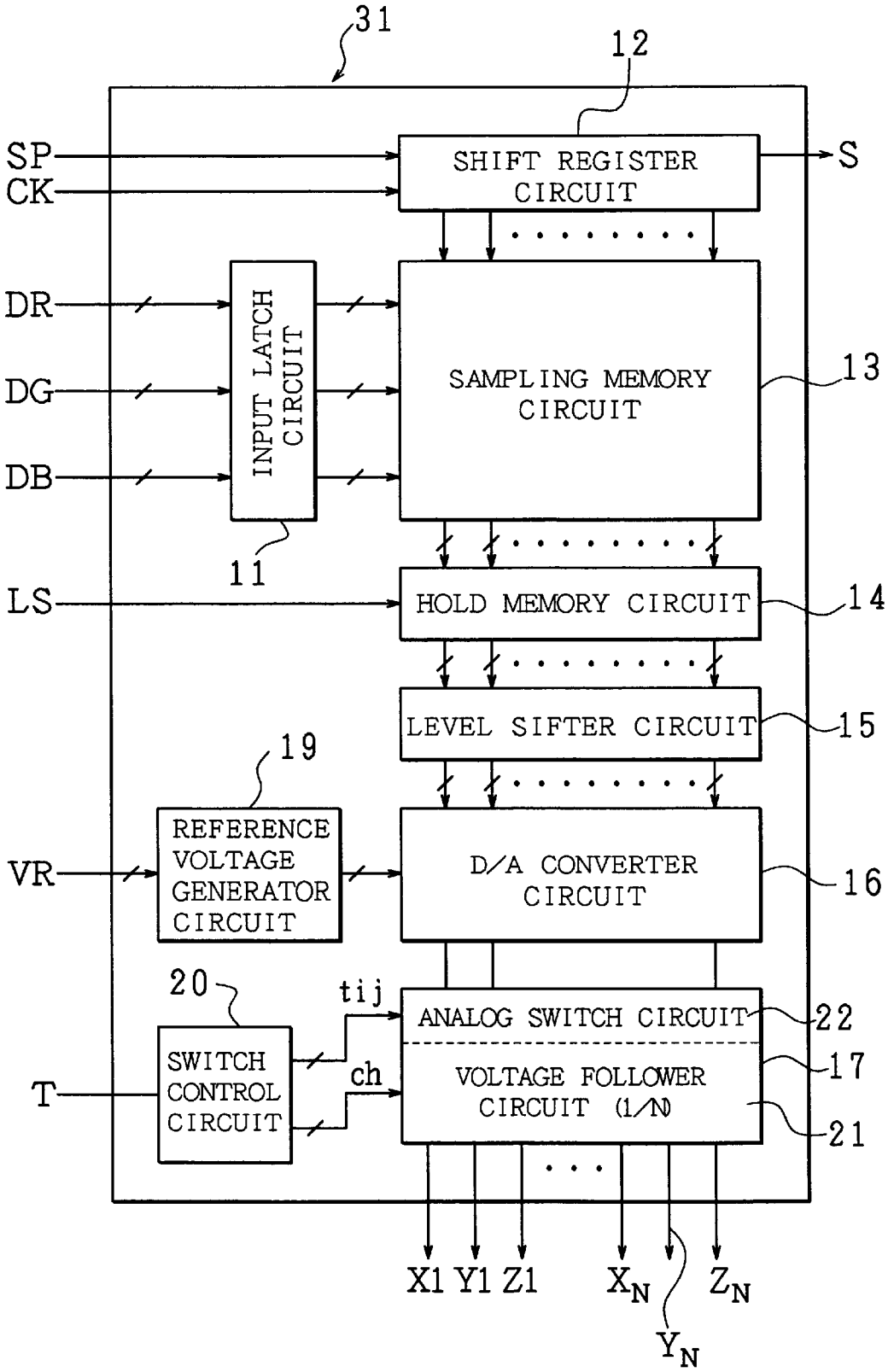
FIG. 7 is a block diagram showing a source driver that acts as a display driving apparatus of another embodiment of the present invention.
Figure 8:
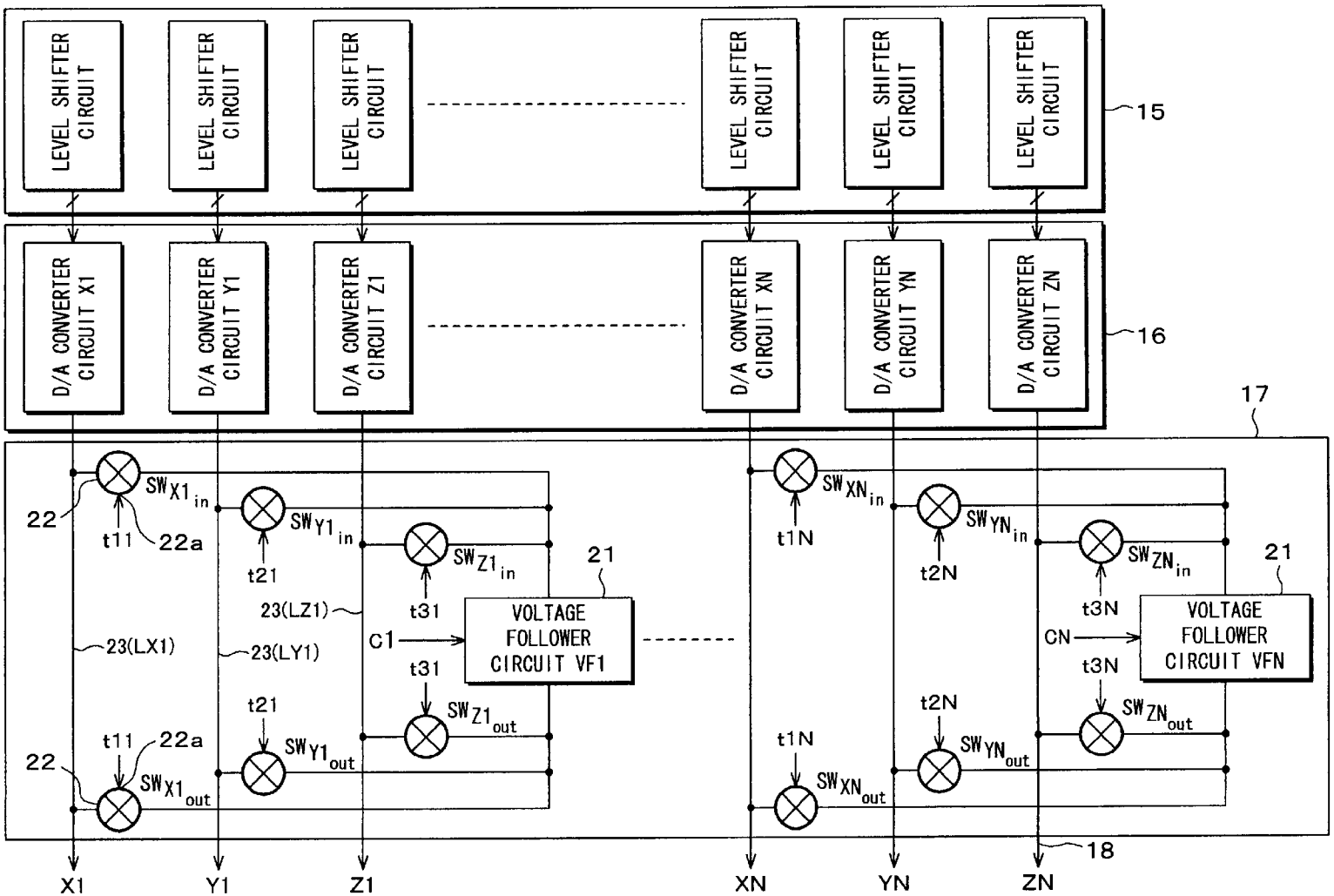
FIG. 8 is a block diagram showing a circuit configuration of the level shifter circuit, the D/A converter circuit, and the output circuit shown in FIG. 7.
Figure 9:
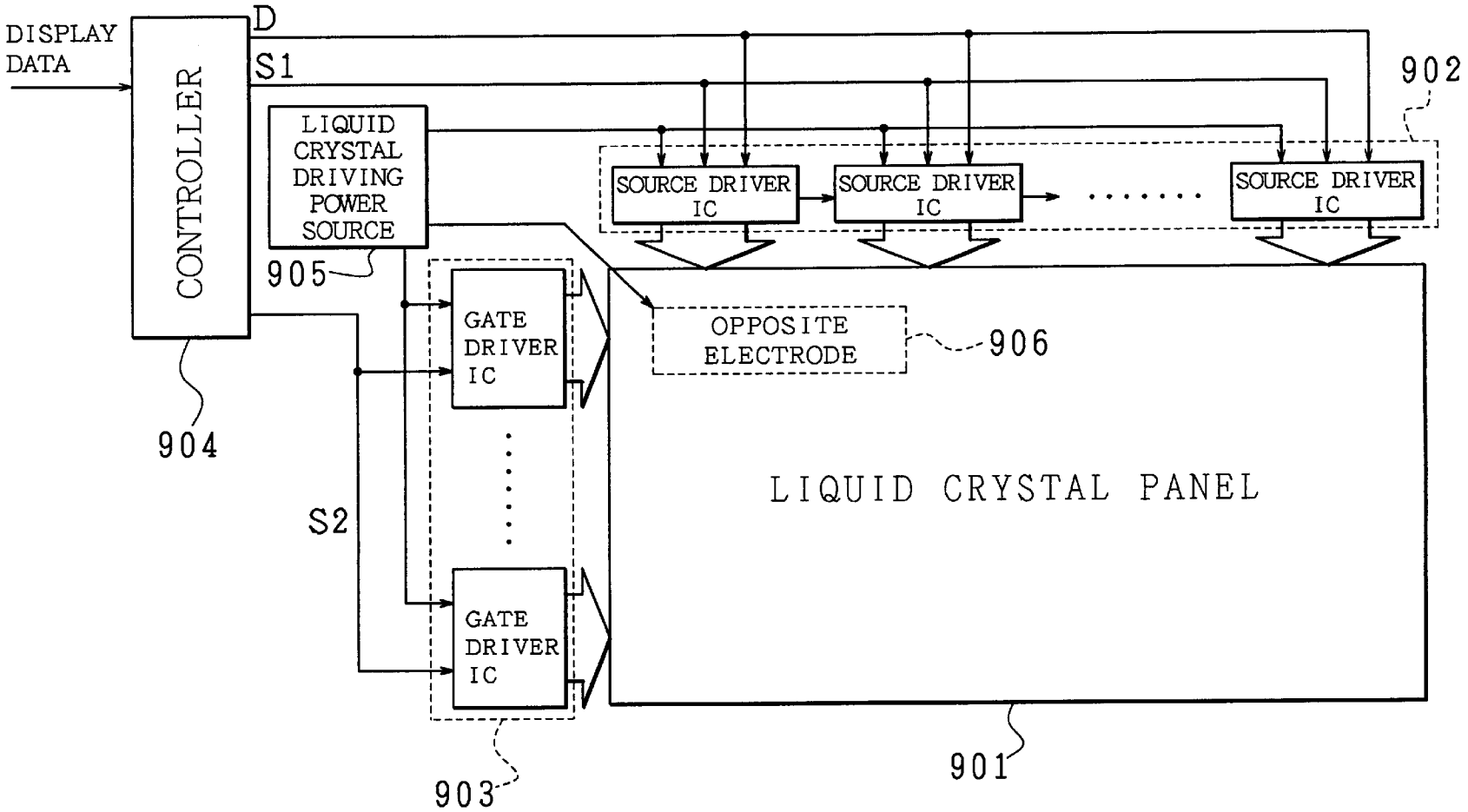
FIG. 9 is a block diagram showing a schematic structure of a conventional liquid crystal display apparatus.

The following description deals with another embodiment of the present invention with reference to FIGS. 7 and 8.

According to the present embodiment, a source driver (display driving apparatus) 31 shown in FIG. 7 is substituted for the source driver 2 shown in FIG. 1. The source driver 31, in order to realize the low power consumption, has the function that cuts off the operation current of the voltage follower circuit 21 when the voltage follower circuit 21 that is constituted by the differential amplifiers is not used. This causes the voltage follower circuit 21 to receive a control signal Ch (h=1 through N) from a switch control circuit 20 in the source driver 31. Note that the control signal tij is sent to an analog switch circuit 22 of an output circuit 17 from the switch control circuit 20, like the source driver 2.

The cut-off of the operation current in the voltage follower circuit 21 can be realized by cutting off the transistors that constitute the constant current source in the voltage follower circuit 21 in accordance with the control signal Ch. The transistors determine the current flowing a differential pair provided at the input stage of the differential amplifier circuits that constitute the voltage follower circuit 21, for example. The cut-off of the operation current can be made (a) by cutting off the transistors, (b) by making a transistor connected with a power source or with a ground potential be turned OFF, and (c) by making transistors (a pair of P-MOS and N-MOS transistors in general) at the output stage which constitutes an output section of the differential amplifier circuit be turned OFF. It is possible for the transistor to be turned OFF, by applying a voltage of a Low level to the transistor, for example.

With the arrangement, it is possible to cut off the operation current flowing in the voltage follower circuit 21 when the voltage follower circuit 21 that is constituted by the differential amplifiers is not used. This ensures to appropriately and timely reduce the useless power consumption, by carrying out the above controlling during the unnecessary period of time in which no display is made in the liquid crystal display apparatus, such as during a blanking period in the TV broadcasting electric waves, so as to stop the operation of the differential amplifier circuits.

Further, in the case where the portable device is provided with the present liquid crystal display apparatus, it is possible to appropriately and timely reduce the useless power consumption, by carrying out the above controlling so as to stop the operation of differential amplifiers until each circuit (including circuits other than the driving apparatus of the liquid crystal display apparatus) reaches the steady state just after the portable device is powered ON.

Still a further, in the case where the control signals C1 through CN are different from each other, it is possible to reduce the power consumption during the switching of the analog switch circuit 22 in the output circuit 17, when the window display (display in part on the screen) is carried out in a liquid crystal display screen, by maintaining to make OFF the analog switch circuit 22 of the output terminals 18 for liquid crystal driving voltages connecting with the source signal line 1004 of the pixel of the background part as long as the display is not affected when the background part of the screen is not changed.

The foregoing embodiment deals with the driving apparatus of liquid crystal display apparatus, especially the source drivers 2 and 31, as the circuit configuration which is provided with the output circuit 17 sharing the low impedance output converter means (voltage follower circuit 21), i.e., the circuit configuration which is provided with switch means (analog switch circuit 22) and the output circuit 17 sharing the low impedance output converter means (voltage follower circuit 21) in the output terminals 18 for liquid crystal driving voltages by selecting the low impedance output converter means (voltage follower circuit 21) in a time-sharing manner. However, the present invention is effective for a driving apparatus of display apparatus, that has pixels provided in a matrix manner, the pixel having a load capacitance including a parasitic capacitance, and carries out the gradation display by changing a voltage to be applied to the pixel, such as a liquid crystal display apparatus and an EL (Electro Luminescence) display apparatus. The present invention is especially effective for the case where a high voltage is applied to the pixel.

As is clear from the description, the display driving apparatus and the display apparatus module of the present invention are arranged so that the low impedance output means that is constituted by the analog circuit (i.e., the voltage follower circuit 21) is shared. This ensures to suppress the increasing in the circuit scale (i.e., the chip size) with the increasing in the number of terminals and the increasing of the power consumption. For example, when a single voltage follower circuit 21 is shared by a plurality of output terminals 18 (N output terminals 18) for liquid crystal driving voltages, it is possible to reduce the power consumption on the output side to 1/N.

The reduction of the chip size and the low power consumption caused by the sharing are effective not only for the foregoing monitor usages but also for a liquid crystal display apparatus for portable terminal device-use in which the miniaturization, the lightweight, the low power consumption are strongly requested.

Further, in the respective differential amplifier circuits of the voltage follower circuit 21 that is used as the low impedance output means by the sharing, even when the display unevenness occurs due to the unevenness of the factors such as the manufacturing conditions (i.e., the display unevenness occurs on the output side due to the offset voltages at the input stage of the differential amplifier circuits), it is possible to eliminate the display unevenness.

In addition, since the operation of the voltage follower circuit 21 (i.e., the output circuit 17) is stopped after charging and discharging the output load, the output voltages from the output terminals 18 for liquid crystal driving voltages are determined by the direct output signals from the D/A converter circuit 16. According to the arrangement, the deviation of the outputs is reduced. Further, the arrangement ensures great effect on the reduction of the consumed current.

As has been described, a display driving apparatus in accordance with the present invention, in which a plurality of types of driving voltages that vary depending on display data are outputted to a display section from a plurality of output terminals via low impedance output means, and is characterized in that (a) each low impedance output means is connected with the plurality of output terminals via switch means, and (b) the low impedance output means is shared by the plurality of output terminals in response to the switch means.

With the arrangement, a single low impedance output section is connected with a plurality of output terminals via the switch means. The switching operation of the switch means allows that the single low impedance output means is used by the plurality of output terminals. Namely, the single low impedance output means is shared by the plurality of output terminals. Accordingly, when compared with the case where low impedance output means are provided for respective output terminals, it is possible to suppress the increasing in the circuit scale of the liquid crystal driving apparatus (i.e., the chip size of the case where the liquid crystal driving apparatus is in the form of chip) with the increasing in the number of output terminals and the increasing of the power consumption.

Further, since the low impedance output means is shared, it is possible to avoid that the display unevenness occurs due to the voltage deviation, on the output side, which is caused by the offset voltages at the input stage of differential amplifier circuits, the offset voltages being generated by the unevenness of the factors such as the manufacturing conditions in the respective differential amplifier circuits used as the low impedance output section.

A display driving apparatus in accordance with the present invention is provided with voltage generation means for generating a variety of types of voltages that drive display means in accordance with display data; a plurality of output terminals; voltage selection means for selecting and outputting one driving voltage for every output terminal among the plurality of types driving voltages in accordance with the display data; low impedance output means having a low output impedance; switch means for connecting or disconnecting each of the low impedance output means with or from the voltage selection means and the plurality of output terminals; and switch control means for controlling in a time-sharing manner the switch means so that the low impedance output means is successively connected with one of the plurality of output terminals.

With the arrangement, a single low impedance output means is connected or disconnected with or from the voltage selection means and the output terminals by the switch means. The switch control means controls the switch means in a time-sharing manner so that the low impedance output means is successively connected with one of the plurality of output terminals. Since a single low impedance output means is shared by the plurality of output terminals, when compared with the case where the low impedance output means are provided for the respective output terminals, it is possible to suppress the increasing in the circuit scale of the liquid crystal driving apparatus (i.e., the chip size of the case where the liquid crystal driving apparatus is in the form of chip) with the increasing in the number of output terminals and the increasing of the power consumption.

Further, since the low impedance output means is shared, it is possible to avoid that the display unevenness occurs due to the voltage deviation, on the output side, which is caused by the offset voltages at the input stage of differential amplifier circuits, the offset voltages being generated by the unevenness of the factors such as the manufacturing conditions in the respective differential amplifier circuits used as the low impedance output means.

The display driving apparatus may be arranged so as to have a plurality of blocks that include said one low impedance output means, the switch means, and a plurality of output terminals which are connected with the low impedance output means via the switch means and arranged so that the switch control means controls the switch means so as to have respective different timings of connecting of the switch means among the blocks.

With the arrangement, the respective timings at which the switch means of the respective blocks are in a connecting state among the blocks shift to each other. Accordingly, it is possible to avoid that the peaks of the consumed currents concentrate when the switch means are in a connecting state. This ensures to suppress the power consumption in a display driving apparatus in which the battery is used as the power source.

The display driving apparatus may be arranged so that the switch control means stops the operation of the switch means when it is not necessary for the output terminals to output the driving voltages.

With the arrangement, since the useless switching operation of the switch means is suppressed, it is possible to reduce the power consumption in the display driving apparatus.

The display driving apparatus may be arranged so that the voltage selection means is directly connected with the output terminals via a plurality of output lines, the low impedance output means is provided so as to be connected in parallel with the output lines via the switch means, and the output of the voltage selection means is directly supplied to the output terminal irrespective of whether the output of the low impedance output means exists or not.

With the arrangement, even when the connecting of one of the output terminals with the low impedance output means is cut off, the output of the voltage selection means is directly supplied to the output terminal by the controlling of the switch means in accordance with the switch control means. This ensures the output terminal to maintain a predetermined driving voltage.

The display driving apparatus may be arranged so that the voltage selection means is directly connected with the output terminals via a plurality of output lines, the low impedance output means is provided so as to be connected in parallel with the output lines via the switch means, and the output of the voltage selection means is directly supplied to the output terminal even after cutting off the output of the low impedance output means.

With the arrangement, even when the connecting of one of the output terminals with the low impedance output means is cut off, the output of the voltage selection means is directly supplied to the output terminal by the controlling of the switch means in accordance with the switch control means. This ensures the output terminal to maintain a predetermined driving voltage.

The display driving apparatus may be arranged so that the low impedance output means cuts off internal operation current during its non-operation.

With the arrangement, since the useless operation current is cut off during the non-operation in the low impedance output means, it is possible to further reduce the power consumption.

A display apparatus module in accordance with the present invention, as has been described earlier, includes any one of the display driving apparatuses.

With the arrangement of the display apparatus module, it is possible to suppress the increasing in the circuit scale of the liquid crystal driving apparatus (i.e., the chip size of the case where the liquid crystal driving apparatus is in the form of chip) with the increasing in the number of output terminals and the increasing of the power consumption. Further, since the low impedance output section is shared, it is possible to avoid that the display unevenness occurs due to the voltage deviation, on the output side, which is caused by the offset voltages at the input stage of differential amplifier circuits, the offset voltages being generated by the unevenness of the factors such as the manufacturing conditions in the respective differential amplifier circuits used as the low impedance output section.

There are described above novel features which the skilled man will appreciate give rise to advantages. There are each independent aspects of the invention to be covered by the present application, irrespective of whether or not they are included within the scope of the following claims.

What is claimed is:

1. A display driving apparatus which outputs a plurality of types of driving voltages to display means in accordance with display data, comprising:

a plurality of output terminals for outputting said plurality of types of driving voltages to said display means, said plurality of output terminals being connectable to source signal lines of said display means;

low impedance output means which outputs to said plurality of output terminals said plurality of types of driving voltages after being subjected to low impedance; and switch means for selectively switching to an output terminal among said plurality of output terminals, which receive said plurality of types of driving voltages from said low impedance output means, wherein each of the low impedance output means is connected with the plurality of output terminals via said switch means, and the low impedance output means is shared by the plurality of output terminals in response to the switch means.

2. The display driving apparatus as set forth in claim 1, further comprising:

a plurality of blocks, each block including one of the low impedance output means; the switch means; and the plurality of output terminals connected with the low impedance output means via the switch means, and switch control means for controlling in a time-sharing manner the switch means so that the low impedance output means is successively connected with one of the plurality of output terminals, the switch control means controlling the switch means so that respective timings at which the switch means of the respective blocks are in a connecting state are shifted to each other among the blocks.

3. A display driving apparatus comprising:

voltage generation means for generating a variety of types of voltages that drive display means in accordance with display data;

a plurality of output terminals for outputting said variety of types of driving voltages to said display means, said plurality of output terminals being connectable to source signal lines of said display means;

voltage selection means for selecting and outputting one driving voltage for every output terminal among the plurality of types of driving voltages in accordance with the display data;

low impedance output means having a low output impedance, which outputs to the plurality of output terminals the driving voltage as selected by said voltage selection means after the driving voltage is subjected to low impedance;

switch means for connecting or disconnecting each of the low impedance output means with or from the voltage selection means and the plurality of output terminals; and switch control means for controlling in a time-sharing manner the switch means so that the low impedance output means is successively connected with one of the plurality of output terminals.

4. The display driving apparatus as set forth in claim 3, further comprising:

a plurality of blocks, each block including each of the low impedance output means; the switch means; and the plurality of output terminals connected with the low impedance output means via the switch means, the switch control means controlling the switch means so that respective timings at which the switch means of the respective blocks are in a connecting state are shifted to each other among the blocks.

5. The display driving apparatus as set forth in claim 3, wherein the switch control means stops the operation of the switch means when it is not necessary for the output terminals to output the driving voltages.

6. The display driving apparatus as set forth in claim 3, wherein the voltage selection means is directly connected with the output terminals via a plurality of output lines, the low impedance output means is provided so as to be connected in parallel with the output lines via the switch means, and an output of the voltage selection means is directly supplied to the output terminal irrespective of whether an output of the low impedance output means exists or not.

7. The display driving apparatus as set forth in claim 3, wherein the voltage selection means is directly connected with the output terminals via a plurality of output lines, the low impedance output means is provided so as to be connected in parallel with the output lines via the switch means, and an output of the voltage selection means is directly supplied to the output terminal even after cutting off an output of the low impedance output means.

8. A display driving apparatus, in which a plurality of types of driving voltages that vary depending on display data are outputted to display means from a plurality of output terminals via low impedance output means, wherein each of the low impedance output means is connected with the plurality of output terminals via switch means, and the low impedance output means is shared by the plurality of output terminals in response to the switch means wherein the low impedance output means cuts off internal operation current during non-operation.

9. A display driving apparatus comprising:

voltage generation means for generating a variety of types of voltages that drive display means in accordance with display data;

a plurality of output terminals;

voltage selection means for selecting and outputting one driving voltage for every output terminal among the plurality of types driving voltages in accordance with the display data;

low impedance output means having a low output impedance;

switch means for connecting or disconnecting each of the low impedance output means with or from the voltage selection means and the plurality of output terminals; and switch control means for controlling in a time-sharing manner the switch means so that the low impedance output means is successively connected with one of the plurality of output terminals, wherein the low impedance output means cuts off internal operation current during non-operation.

10. A display apparatus module comprising:

a display driving apparatus, the display driving apparatus outputting a plurality of types of driving voltages to display means in accordance with display data, a plurality of output terminals for outputting said plurality of types of driving voltages to said display means, said plurality of output terminals being connectable to source signal lines of said display means;

low impedance output means which outputs to said plurality of output terminals said plurality of types of driving voltages after the driving voltages are subjected to low impedance; and switch means for selectively switching to an output terminal among said plurality of output terminals, which receive said plurality of types of driving voltages from said low impedance output means, wherein each of the low impedance output means is connected with the plurality of output terminals via said switch means, and the low impedance output means is shared by the plurality of output terminals in response to the switch means.

11. The display apparatus module as set forth in claim 10, further comprising:

a plurality of blocks, each block including one of the low impedance output means; the switch means; and the plurality of output terminals connected with the low impedance output means via the switch means, and switch control means for controlling in a time-sharing manner the switch means so that the low impedance output means is successively connected with one of the plurality of output terminals, and the switch control means controlling the switch means so that respective timings at which the switch means of the respective blocks are in a connecting state are shifted to each other among the blocks.

12. A display apparatus module comprising a display driving apparatus, the display driving apparatus including:

voltage generation means for generating a variety of types of voltages that drive display means in accordance with display data;

a plurality of output terminals for outputting said variety of types of driving voltages to said display means, said plurality of output terminals being connectable to source signals lines of said display means;

voltage selection means for selecting and outputting one driving voltage for every output terminal among the plurality of types of driving voltages in accordance with the display data;

low impedance output means having a low output impedance, which outputs to the plurality of output terminals the driving voltage as selected by said voltage selection means after the driving voltage is subjected to low impedance;

switch means for connecting or disconnecting each of the low impedance output means with or from the voltage selection means and the plurality of output terminals; and switch control means for controlling in a time-sharing manner the switch means so that the low impedance output means is successively connected with one of the plurality of output terminals.

13. The display apparatus module as set forth in claim 12, further comprising:

a plurality of blocks, each block including one of the low impedance output means; the switch means; and the plurality of output terminals connected with the low impedance output means via the switch means, and the switch control means controlling the switch means so that respective timings at which the switch means of the respective blocks are in a connecting state are shifted to each other among the blocks.

14. The display apparatus module as set forth in claim 12, wherein the switch control means stops the operation of the switch means when it is not necessary for the output terminals to output the driving voltages.

15. The display apparatus module as set forth in claim 12, therein the voltage selection means is directly connected with the output terminals via a plurality of output lines, the low impedance output means is provided so as to be connected in parallel with the output lines via the switch means, and an output of the voltage selection means is directly supplied to the output terminal irrespective of whether an output of the low impedance output means exists or not.

16. The display apparatus module as set forth in claim 12, wherein the voltage selection means is directly connected with the output terminals via a plurality of output lines, the low impedance output means is provided so as to be connected in parallel with the output lines via the switch means, and an output of the voltage selection means is directly supplied to the output terminal even after cutting off an output of the low impedance output means.

17. A display apparatus module comprising a display driving apparatus, the display driving apparatus outputting a plurality of types of driving voltages that vary depending on display data to a display means from a plurality of output terminals via low impedance output means, each of the low impedance output means being connected with the plurality of output terminals via a switch means, and the low impedance output means being shared by the plurality of output terminals in response to the switch means, wherein the low impedance output means cuts off internal operation current during non-operation.

18. A display apparatus module comprising a display driving apparatus, the display driving apparatus including:

voltage generation means for generating a variety of types of voltages that drive display means in accordance with display data;

a plurality of output terminals;

voltage selection means for selecting and outputting one driving voltage for every output terminal among the plurality of types driving voltages in accordance with the display data;

low impedance output means having a low output impedance;

switch means for connecting or disconnecting each of the low impedance output means with or from the voltage selection means and the plurality of output terminals; and switch control means for controlling in a time-sharing manner the switch means so that the low impedance output means is successively connected with one of the plurality of output terminals, wherein the low impedance output means cuts off internal operation current during non-operation.

* * * * *